US008191885B2

(12) United States Patent
Hattori et al.

(10) Patent No.: US 8,191,885 B2
(45) Date of Patent: Jun. 5, 2012

(54) HOME-POSITION DETECTING METHOD, SHEET PROCESSING DEVICE, AND IMAGE FORMING APPARATUS

(75) Inventors: Hitoshi Hattori, Tokyo (JP); Masahiro Tamura, Kanagawa (JP); Nobuyoshi Suzuki, Tokyo (JP); Shuuya Nagasako, Kanagawa (JP); Kazuhiro Kobayashi, Kanagawa (JP); Hiroshi Maeda, Aichi (JP); Tomoichi Nomura, Aichi (JP); Ichiro Ichihashi, Aichi (JP); Akira Kunieda, Tokyo (JP); Makoto Hidaka, Tokyo (JP); Naohiro Kikkawa, Kanagawa (JP); Junichi Tokita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 819 days.

(21) Appl. No.: 12/230,097

(22) Filed: Aug. 22, 2008

(65) Prior Publication Data

US 2009/0060604 A1 Mar. 5, 2009

(30) Foreign Application Priority Data

Aug. 28, 2007 (JP) ..... 2007-221122

(51) Int. Cl.
*B65H 37/04* (2006.01)

(52) U.S. Cl. ..... 270/58.09; 270/37; 270/45

(58) Field of Classification Search ..... 270/58.08, 270/58.09, 37, 45, 39.01
See application file for complete search history.

(56) References Cited

U.S. PATENT DOCUMENTS

| | | | | |
|---|---|---|---|---|
| 5,072,920 | A * | 12/1991 | Kubota et al. | 270/58.11 |
| 5,321,466 | A * | 6/1994 | Kimura et al. | 399/79 |
| 5,573,233 | A * | 11/1996 | Hirai et al. | 270/58.08 |
| 6,102,385 | A * | 8/2000 | Wakamatsu et al. | 270/58.12 |
| 7,062,213 | B2 * | 6/2006 | Ishikura et al. | 399/367 |
| 7,207,557 | B2 | 4/2007 | Kaneko et al. | |
| 7,328,892 | B2 | 2/2008 | Asami et al. | |
| 2003/0160376 | A1 * | 8/2003 | Yamada et al. | 270/58.07 |
| 2006/0261544 | A1 | 11/2006 | Tamura et al. | |
| 2007/0182082 | A1 | 8/2007 | Asami et al. | |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |

FOREIGN PATENT DOCUMENTS

JP 56-085759 7/1981

(Continued)

OTHER PUBLICATIONS

Abstract of JP 05-085081 published Apr. 6, 1993.

(Continued)

*Primary Examiner* — Patrick Mackey
(74) *Attorney, Agent, or Firm* — Harness, Dickey & Pierce, P.L.C.

(57) ABSTRACT

A processing unit performs a predetermined processing on a sheet in a process of carrying the sheet. A home-position detecting unit detects a home position of a moving member of the processing unit by detecting a part of the moving member using a detecting unit. The home-position detecting unit sets in advance a detection range for recognizing the home position, and when a part to detect the home position is detected in a state in which the moving member is stopped, sets a detection position as the home position by assuming that the detection position is in the detection range without moving the moving member once out of a detection range of the detecting unit.

11 Claims, 31 Drawing Sheets

FOREIGN PATENT DOCUMENTS

| | | |
|---|---|---|
| JP | 2922683 | 4/1999 |
| JP | 11-334983 | 12/1999 |
| JP | 2004-123346 | 4/2004 |
| JP | 2004-196528 | 7/2004 |
| JP | 2004-246298 | 9/2004 |
| JP | 2005-015225 | 1/2005 |
| JP | 2005-022823 | 1/2005 |
| JP | 3635898 | 1/2005 |
| JP | 2006-106219 | 4/2006 |
| JP | 2007-044821 | 2/2007 |

OTHER PUBLICATIONS

Abstract of JP 11-139677 published May 25, 1999.

* cited by examiner

HOME-POSITION DETECTING METHOD, SHEET PROCESSING DEVICE, AND IMAGE FORMING APPARATUS

CROSS-REFERENCE TO RELATED APPLICATIONS

The present application claims priority to and incorporates by reference the entire contents of Japanese priority document 2007-221122 filed in Japan on Aug. 28, 2007.

BACKGROUND OF THE INVENTION

1. Field of the Invention

The present invention relates to a home-position detecting method for detecting a home position of an operation target member, a sheet processing device that carries a sheet-like recording medium (simply referred to as "paper" in the present specification), and performs the home-position detecting method of a processing unit that performs a predetermined process, and an image forming apparatus including the sheet processing device.

2. Description of the Related Art

A sheet processing device having a function of feeding paper and performing a predetermined process on paper essentially requires a so-called homing operation of a home-position return operation to control positions of various mechanisms that perform paper punching, paper alignment, stapling, or the like. The homing operation is performed by combining a prescribed pattern operation with detection information of a position sensor. The homing operation also includes an abnormality detection operation, and the sheet processing device determines that the mechanism is abnormal when the homing operation cannot be normally performed. The homing operation is performed mainly at the time of turning on a power source or when a door of the device is closed.

As a technique related to the homing operation of the sheet processing device, inventions described in Japanese Patent Application Laid-open No. H11-334983 and Japanese. Patent No. 3635898 are known. Japanese Patent Application Laid-open No. H11-334983 discloses a sheet post-processing device capable of detecting, in a simple configuration, a deviation of a binding position of sheets of paper at the time of performing a binding process to the sheets. To increase the reliability of the binding process, the sheet post-processing device includes: a processing unit that processes sheets; a processing-unit moving unit that moves the processing unit to a sheet processing position by driving a pulse motor; a pulse generating unit that transmits a pulse to a pulse motor that drives the processing-unit moving unit; and a home-position detecting unit that confirms a completion of the operation of the processing-unit moving unit. When the processing-unit moving unit moves, the sheet post-processing device compares the generated number of pulses scheduled in advance with the number of pulses generated by the pulse generating unit, when the home-position detecting unit detects the home position. With this arrangement, the sheet post-processing device detects an abnormal operation of the processing-unit moving unit.

Further, Japanese Patent No. 3635898 discloses an image forming system including an image forming apparatus, and a paper post-processing device that performs post processing of paper discharged from the image forming apparatus. The image forming system includes a control unit that controls the paper post-processing device to prohibit all operations of the paper post-processing device other than communication, during an energy saving mode in which power is supplied to the paper post-processing device and the paper post-processing device can communicate with the image forming apparatus. When a body door of the paper post-processing device is opened or closed during the energy saving mode, the energy saving mode is shifted to a normal mode, and the control unit controls the paper post-processing device to perform an initial operation.

As described above, in operating the homing operation, various kinds of mechanisms are driven to move members to be position-controlled or stopped. Therefore, noise occurs, power is consumed, and parts are abraded due to this operation. Particularly, a recent multi function peripheral such as the paper post-processing device (for example, a finisher) includes many mechanisms that perform homing operations. Therefore, the multi function peripheral requires a long time to complete the homing operation of the mechanism, and delays the processing operation, in addition to having the above inconvenience.

SUMMARY OF THE INVENTION

It is an object of the present invention to at least partially solve the problems in the conventional technology.

According to an aspect of the present invention, there is provided a method of detecting a home position of a moving member by detecting a part of the moving member using a detecting unit. The method includes setting in advance a detection range within which the home position can be recognized; and setting, when the detecting unit detects a part to detect the home position of the moving member in a state in which the moving member is stopped, a detection position as the home position by assuming that the detection position is in the detection range without operating the moving member once to move the moving unit out of a detection range of the detecting unit.

Furthermore, according to another aspect of the present invention, there is provided a sheet processing device including a processing unit that performs a predetermined processing on a sheet in a process of carrying the sheet, the processing unit including a moving member; and a home-position detecting unit that detects a home position of the moving member by detecting a part of the moving member using a detecting unit. The home-position detecting unit sets in advance a detection range within which the home position can be recognized, and when the detecting unit detects a part to detect the home position of the moving member in a state in which the moving member is stopped, sets a detection position as the home position by assuming that the detection position is in the detection range without operating the moving member once to move the moving unit out of a detection range of the detecting unit.

Moreover, according to still another aspect of the present invention, there is provided an image forming apparatus including a sheet processing device that includes a processing unit that performs a predetermined processing on a sheet in a process of carrying the sheet, the processing unit including a moving member; and a home-position detecting unit that detects a home position of the moving member by detecting a part of the moving member using a detecting unit. The home-position detecting unit sets in advance a detection range within which the home position can be recognized, and when the detecting unit detects a part to detect the home position of the moving member in a state in which the moving member is stopped, sets a detection position as the home position by assuming that the detection position is in the detection range without operating the moving member once to move the moving unit out of a detection range of the detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
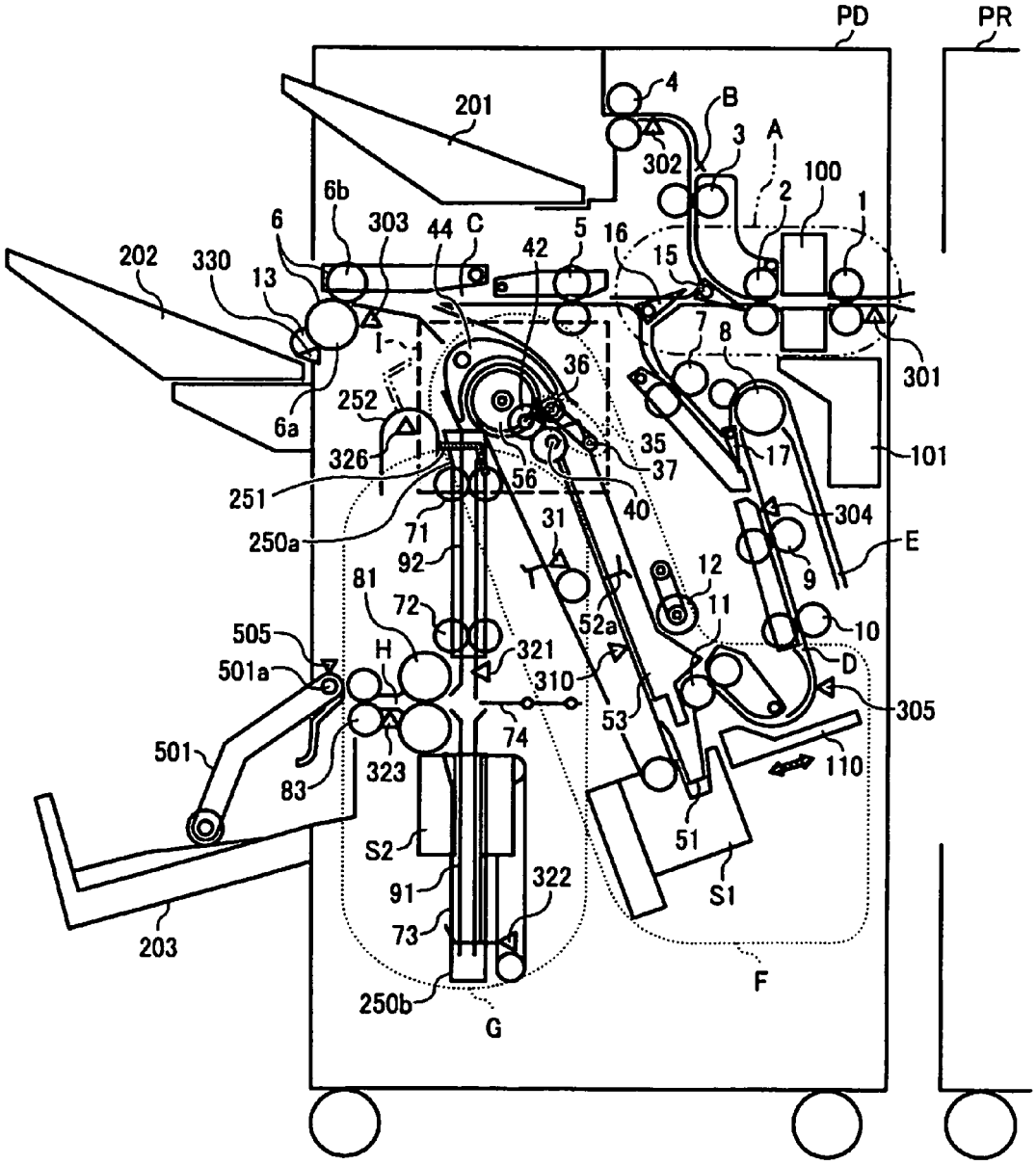
FIG. 1 is an entire configuration diagram of a system including a sheet post-processing device and an image forming apparatus according to an embodiment of the present invention.

Exemplary embodiments of the present invention will be explained in detail below with reference to the accompanying drawings.

In an embodiment of the present invention, a part of an operation target member corresponds to a recess 20*a* of a shift-sensor filler 20 and convexes 110*a*' 110*b*', and 110*c*'. A home-position detecting unit corresponds to a shift sensor 336, home sensors 111*a*, 111*b*, and 111*c*, and a stapler-movement home-position (HP) sensor 312. A control unit, an abnormality detecting unit, and a communication unit correspond to functions of a central processing unit (CPU) 360. A storing unit corresponds to a volatile memory 381 or a non-volatile memory 382. A path for feeding paper to a proof tray corresponds to a feed path B. A processing unit corresponds to a punch unit 100. An alignment function corresponds to a rear-end fence 51 and a jogger fence 53, and a movable rear-end fence 73, an upper jogger fence 250*a*, and a lower jogger fence 250*b*. A staple function corresponds to an end-surface binding stapler S1 (hereinafter, also simply "stapler S1"), and a middle-binding stapler S2. A folding function corresponds to a folding plate 74 and a folding roller 81. A cutting function corresponds to a small cutter.

1. Entire Configuration

FIG. 1 is a system configuration diagram of a system including a sheet post-processing device PD and an image forming apparatus PR as a sheet processing device according to the present embodiment.

In FIG. 1, the sheet post-processing device PD is fitted to a side of the image forming apparatus PR, and sheets discharged from the image forming apparatus PR are guided to the sheet post-processing device PD. The sheets are configured to be sorted by branch claws 15 and 16, to a feed path A having a post-processing device (the punch unit 100 in the present embodiment) that performs post processing to the sheets, the feed path B for guiding the sheets to an upper tray 201 via the feed path A, a feed path C for guiding the sheets to a shift tray 202, and a feed path D guiding the sheets to a processing tray F (hereinafter, also referred to as "end-surface-binding processing tray F") that performs alignment, stapling or the like.

Although not shown, the image forming apparatus PR includes at least an image processing circuit that converts input image data into printable image data, an optical writing device that optically writes an image onto a photoconductor based on an image signal output from the image processing circuit, a developing device that toner-develops a latent image formed by optical writing on the photoconductor, a transfer device that transfers a toner image developed by the developing device onto sheets, and a fixing device that fixes toner images transferred to the sheets. The image forming apparatus PR sends the sheets fixed with the toner images to the sheet post-processing device PD. The sheet post-processing device PD performs desired post processing. While the image forming apparatus PR in this example is an electrophotographic system as described above, all known types of image forming apparatuses including inkjet system, thermal transfer system, or the like can be also used. In the present embodiment, the image processing circuit, the optical writing device, the developing device, the transfer device, and the fixing device constitute an image forming unit.

The sheets guided to the end-surface-binding processing tray F via the feed paths A and D and aligned and stapled in this end-surface-binding processing tray F are sorted by a guide member 44 to the feed path C leading to the shift tray 202, and a middle-binding/middle-folding processing tray G (hereinafter, also simply referred to as "middle-binding processing tray G"). The sheets folded in the middle-binding processing tray G are guided to a lower tray 203 through a feed path H. A branch claw 17 is arranged in the feed path D, and is held in a state as shown in FIG. 1 by a low load spring (not shown). After a rear end of the sheets carried by a carrying roller 7 passes through the branch claw 17, at least a carrying roller 9 of carrying rollers 9 and 10, and a staple paper-discharge roller 11 is inverted, thereby turning the sheets along a turn guide 8. Accordingly, the sheets are guided to a sheet accommodating unit E from the rear end of the sheets, and are pre-stacked. The sheets are stacked with the next sheet, and can be carried. By repeating this operation, two or more sheets can be also carried in superposition. Reference numeral 304 denotes a pre-stack sensor that sets a return timing at the time of pre-stacking the sheets.

In the feed path A common to the upstream of the feed path B, the feed path C, and the feed path D, an input sensor 301 for detecting a sheet received from the image forming apparatus PR is arranged. At the downstream, there are sequentially laid out an input roller 1, the punch unit 100, a punch-waste hopper 101, a carrying roller 2, the branch claw 15, and the branch claw 16. The branch claw 15 and the branch claw 16 are held in the state shown in FIG. 1 by a spring (not shown). By turning on a solenoid (not shown), the branch claws 15 and 16 are driven. By changing the combination of both branch claws, sheets are sorted to the feed path B, the feed path C, and the feed path D.

To guide the sheets to the feed path B, the solenoid is turned off in the state shown in FIG. 1. To guide the sheets to the feed path C, the solenoid is turned on in the state shown in FIG. 1. Accordingly, the branch claw 15 is rotated upward, and the branch claw 16 is rotated downward. The sheets are discharged to the upper tray 201 via a paper discharge roller 4 from a carrying roller 3. To guide the sheets to the feed path D, the solenoid is turned off with the branch claw 16 left in the state shown in FIG. 1, and the branch claw 15 is rotated upward from the state shown in FIG. 1 by turning on the solenoid. The sheets are carried to the shift tray 202 via a carrying roller 5 and a pair of shift paper-discharge rollers 6 (6*a*, 6*b*).

The sheet post-processing device PD can perform various kinds of processes to the sheets, such as a punching (the punch unit 100), a sheet layout and end binding (the jogger fence 53, the end-surface binding stapler S1), a sheet layout and middle binding (the middle-binding upper-jogger fence 250*a*, the middle-binding lower-jogger fence 250*b*, and the middle-binding stapler S2), a sheet sorting (the shift tray 202), and middle folding (the folding plate 74 and the folding roller 81).

2. Shift Tray Unit

Figure 2:
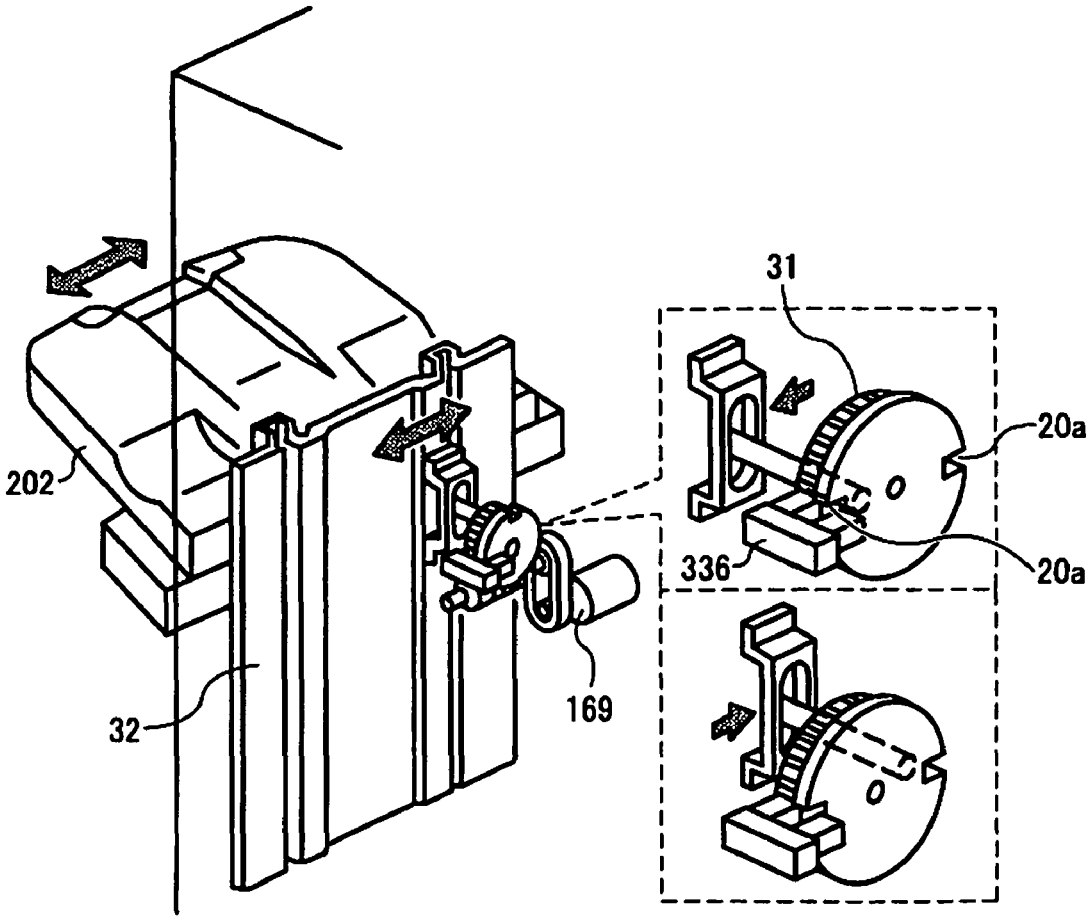
FIG. 2 is a perspective view of a shift mechanism of the sheet post-processing device shown in FIG. 1.

As shown in FIG. 1, a shift-tray paper-discharge unit positioned at the most downstream part of the sheet post-processing device PD includes the pair of shift paper-discharge rollers 6 (6*a*, 6*b*), a return roller 13, a paper surface detector 330, the shift tray 202, a shifting mechanism shown in FIG. 2 that reciprocates the shift tray 202 in a direction orthogonal with the sheet carrying direction, and a shift-tray lifting mechanism that lifts the shift tray 202.

In FIG. 1, the return roller 13 includes a sponge roller to align the rear end of the sheets by butting against an end fence 32, in contact with the sheets discharged from the shift paper-discharge rollers 6. The return roller 13 rotates based on rotation force of the shift paper-discharge rollers 6. A tray-lift limit switch 333 is provided near the return roller 13. When the shift tray 202 is lifted up to press up the return roller 13, the tray-lift limit switch 333 is turned on, and a tray lift motor stops. As a result, overrunning of the shift tray 202 is prevented. Near the return roller 13, there is provided the paper surface detector 330 as a paper-surface-position detecting unit that detects a paper surface position of sheets or a bundle of sheets discharged to the shift tray 202.

In the present embodiment, a paper surface detector (for stapling) 330*a* and a paper surface detector (for non-stapling) 330*b* are turned on when these detectors are shielded by a shielding unit 30*b*. Therefore, when the shift ray 202 is lifted up and when a contacting unit 30*a* of a paper-surface detecting lever 30 is rotated upward, the paper surface detector (for stapling) 330*a* is turned off. When the contacting unit 30*a* further rotates, the paper surface detector (for non-stapling) 330*b* is turned on. When the paper surface detector (for stapling) 330*a* and the paper surface detector (for non-stapling) 330*b* detect that a sheet stacking amount reaches a predetermined height, the shift tray 202 falls by a predetermined amount by a driving of a tray lifting motor 168. As a result, a paper surface position on the shift tray 202 is held at approximately a constant level.

Figure 3:
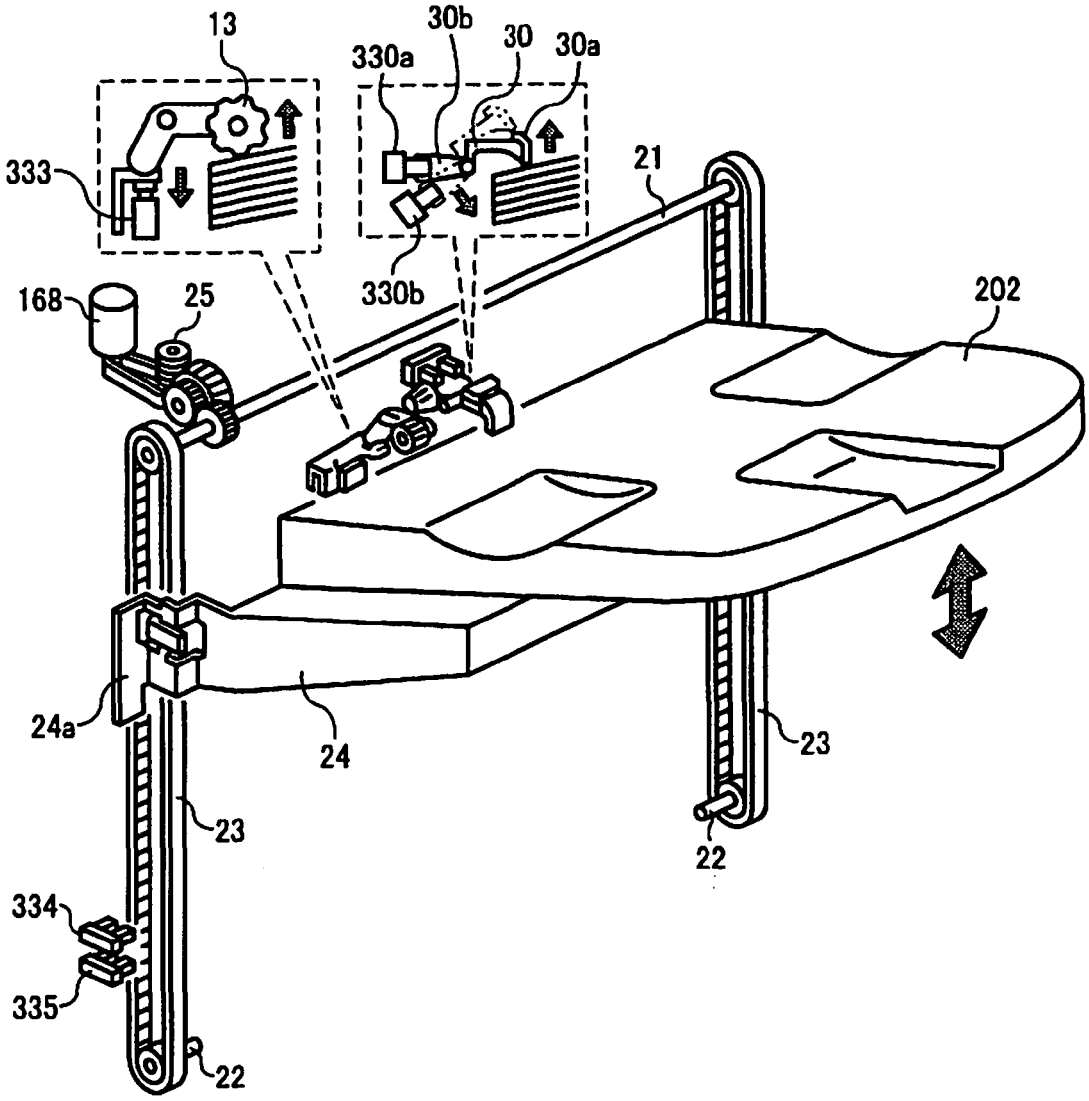
FIG. 3 is a perspective view of a lifting mechanism of a shift tray of the sheet post-processing device shown in FIG. 1.

That is, as shown in FIG. 3, the shift tray 202 is lifted up when a driving axis 21 drives a driving unit. A timing belt 23 is applied with tension via a timing pulley, between the driving axis 21 and a driven axis 22. A side plate 24 for supporting the shift tray 202 is fixed to the timing belt 23. Based on this configuration, a unit including the shift tray 202 is suspended in a liftable manner.

A driving source for moving the shift tray 202 in up and down directions is the tray lifting motor 168 that can be driven in forward and backward directions. Driving force generated by the tray lifting motor 168 is transmitted to a last gear of a gear row fixed to the driving axis 21 via a worm gear 25. Because the worm gear 25 is present in the middle, the shift tray 202 can be held at a constant position, and a drop accident of the shift tray 202 can be prevented.

A shielding plate 24*a* is integrally formed on the side plate 24 of the shift tray 202, and a full-state detector 334 that detects a full state of sheets and a lower-limit sensor 335 that detects a lower-limit position are arranged below. The shielding plate 24*a* turns on and off the full-state detector 334 and the lower-limit sensor 335. The full-state detector 334 and the lower-limit sensor 335 are photosensors, and are turned on when these are shielded by the shielding plate 24*a*. The shift paper-discharge rollers 6 are omitted from FIG. 3.

As shown in FIG. 2, an oscillating mechanism of the shift tray 202 rotates a shift cam 31 using a shift motor 169 as a driving source. A pin stands on the shift cam 31 at a position of a certain distance from a center of the rotation axis. The pin is engaged with a long hole of the end fence 32 guiding the rear end of the stacked sheets on the shift tray 202 and engaged with a direction orthogonal with a sheet discharging direction. The end fence 32 moves to a direction orthogonal with the sheet discharging direction, based on the rotation of the shift cam 31. Along with this movement, the shift tray 202 also moves. The shift tray 202 stops at two positions of front and back. The shift sensor 336 detects the stop position. Based on turning on and off of the shift motor 169, the movement in the direction orthogonal with the sheet discharging direction is controlled.

Figure 4:
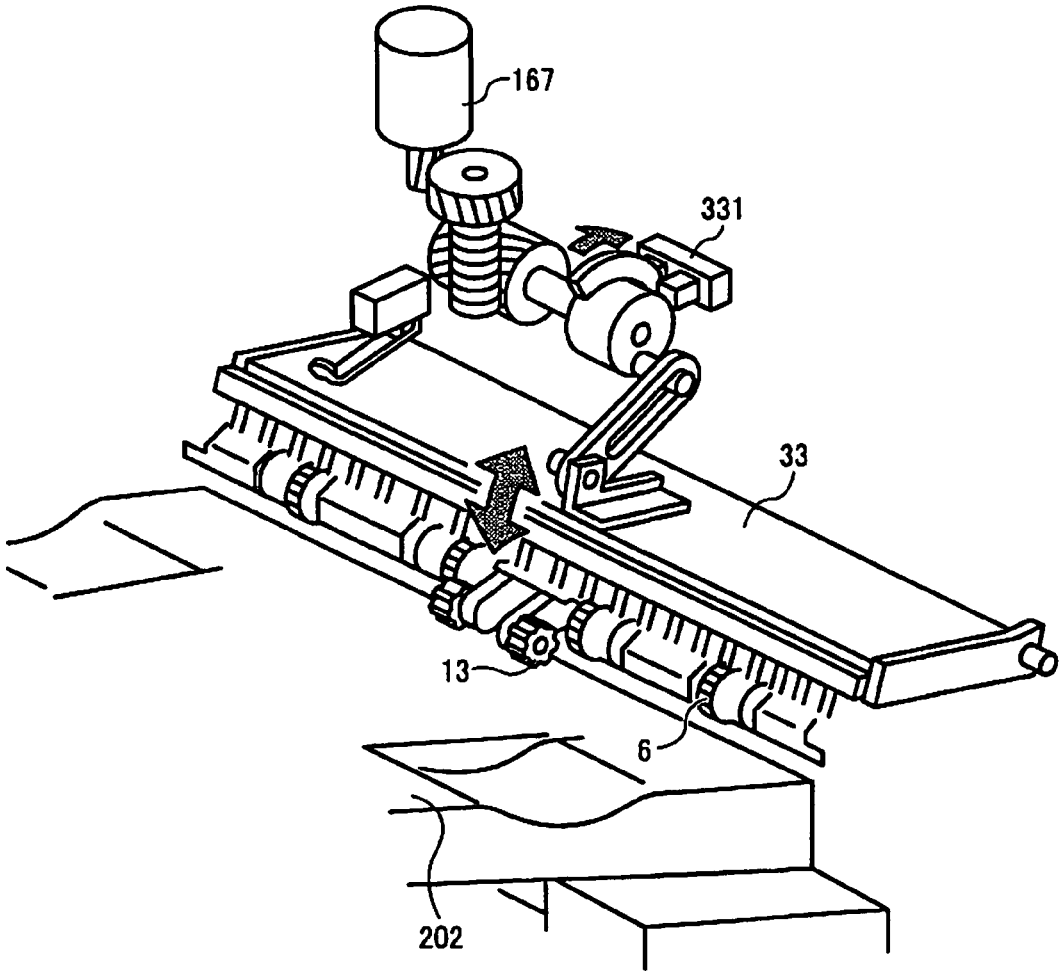
FIG. 4 is a perspective view of a mechanism of a shift paper-discharge roller and an open guide plate of the sheet post-processing device shown in FIG. 1.

The shift paper-discharge rollers 6 include the driving roller 6*a* and the driven roller 6*b*. As shown in FIG. 1 and FIG. 4, the driven roller 6*b* is rotationally supported by a free end of an open guide plate 33 of which upstream in the sheet discharge direction is supported and rotationally provided in up and down directions. The driven roller 6*b* is brought into contact with the driving roller 6*a* by self weight or by biasing force, and the sheets are discharged by being sandwiched between both rollers. When the bound bundle of sheets is discharged, the open guide plate 33 is rotated upward, and is returned at a predetermined timing. This timing is determined based on a detection signal of a shift paper-discharge sensor 303. The stop position is determined based on a detection signal of a paper-discharge-guide-plate open sensor 331, and a paper-discharge-guide-plate open motor 167 drives the paper-discharge-guide-plate open sensor 331.

3. End-Surface-Binding Processing-Tray Unit

FIGS. 5, 6, 12, and 13 depict a configuration of the end-surface-binding processing tray F that performs a stapling process.

3.1 Entire Configuration of End-Surface-Binding Processing Tray

Sheets guided to the end-surface-binding processing tray F by the staple paper-discharge roller 11 are sequentially stacked on the end-surface-binding processing tray F. In this case, the return roller 13 aligns each sheet in a vertical direction (a sheet carrying direction), and the jogger fence 53 aligns the sheets in a lateral direction (also referred to as a sheet width direction orthogonal with the sheet carrying direction). The end-surface binding stapler S1 is driven by a staple signal from a control circuit 350 (see FIG. 33), from a break of a job, that is, an end sheet of the bundle of sheets, to a header sheet of the next bundle of sheets, and a binding process is performed. A discharge belt 52 having a projection of a discharge claw 52*a* immediately sends the bound bundle of sheets to the shift paper-discharge rollers 6, and discharges the bundle of sheets to the shift tray 202 set at a reception position.

3.2 Sheet Discharge Mechanism

Figure 12:
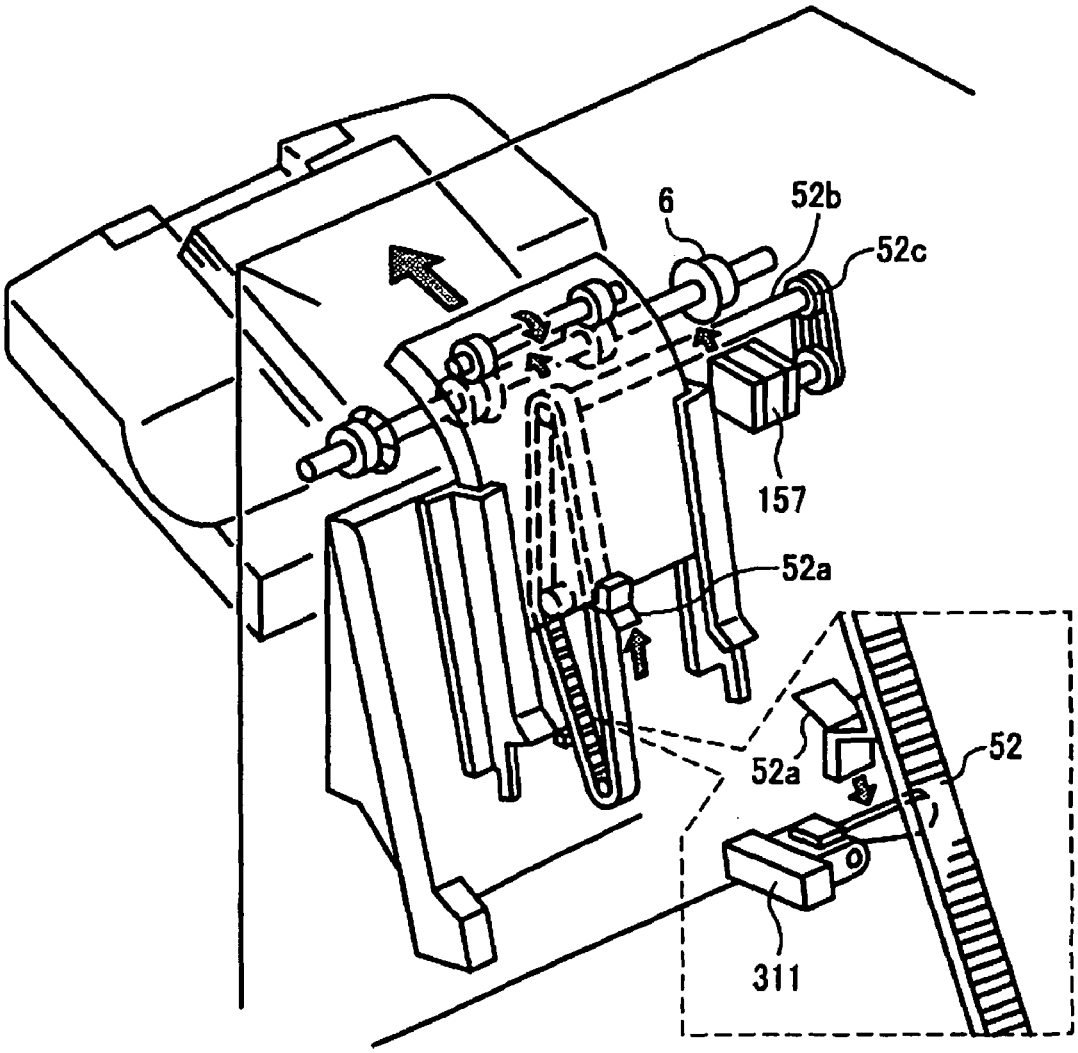
FIG. 12 is a perspective view of a discharge belt for pressing up a bundle of sheets and a driving mechanism of a discharge claw.

A discharge-belt HP sensor 311 detects a home position of the discharge claw 52*a*, as shown in FIG. 12. The discharge belt HP sensor 311 is turned on and off by the discharge claw 52*a* provided on the discharge belt 52. Two discharge claws 52*a* are arranged at opposite positions on the external periphery of the discharge belt 52, and alternately carry the bundle of sheets accommodated in the end-surface-binding processing tray F. The discharge belt 52 is rotated oppositely according to need. A front end of the carrying direction of the bundle of sheets accommodated in the end-surface-binding processing tray F can be arranged on the rear surface of the discharge claw 52*a* at the opposite side of the discharge claw 52*a* waiting to move the bundle of sheets. Therefore, the discharge claw 52*a* also functions as an arranging unit of the bundle of sheets in the sheet carrying direction.

Figure 5:
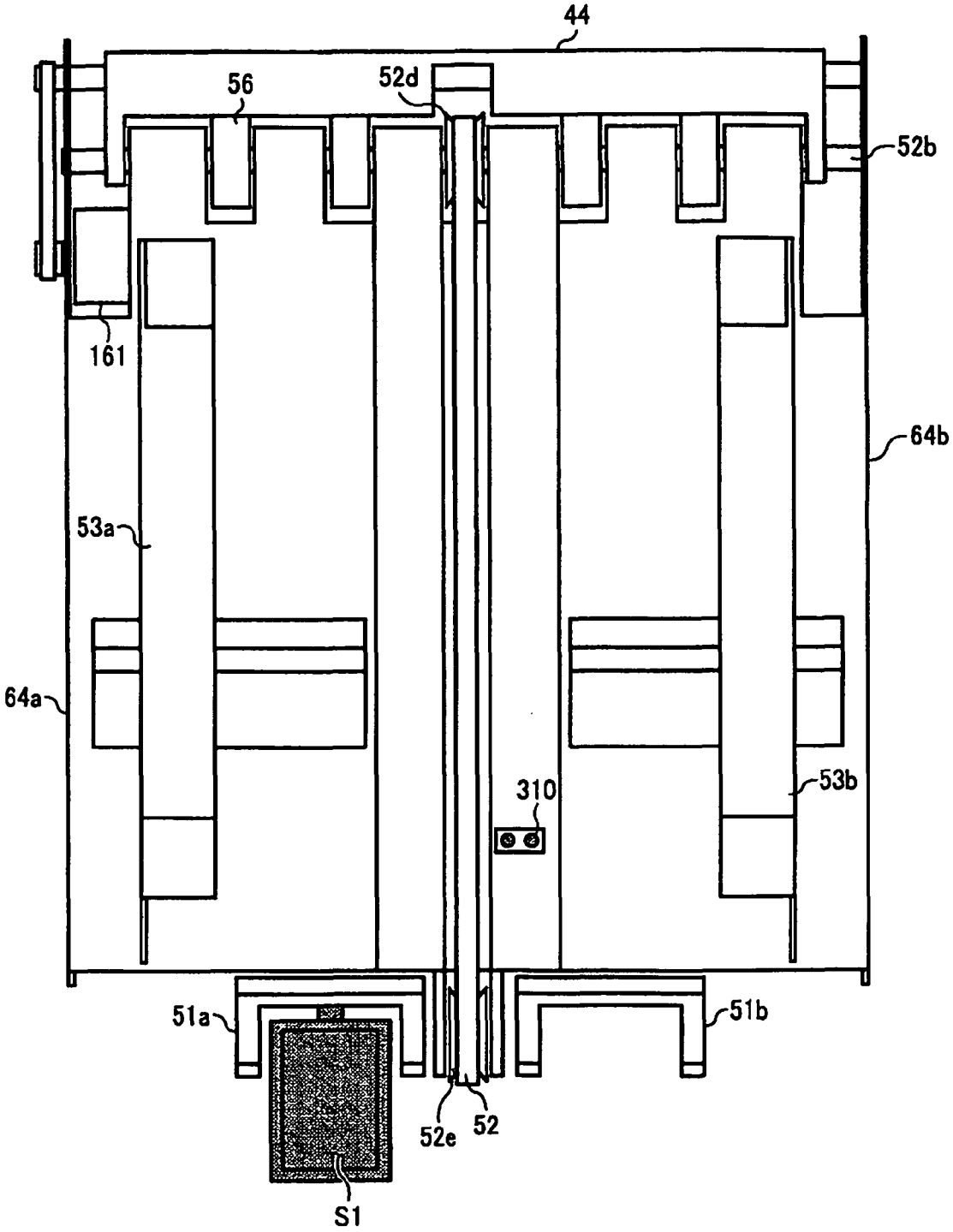
FIG. 5 is a plan view of a configuration of an end-surface-binding processing tray for performing a stapling process.

As shown in FIG. 5, the discharge belt 52 is positioned at the center of alignment in the sheet width direction, is tensioned between a driving pulley 52*d* and a driven pulley 52*e*, and is driven by a discharge motor 157 via a driving axis 52*b* and a pulley 52*c*, as shown in FIG. 12. A plurality of paper discharge rollers 56 are arranged symmetrically with the discharge belt 52, and are rotationally provided relative to the driving axis 52*b*, thereby functioning as driven rollers. Reference numerals respectively 64*a* and 64*b* denote a front side plate and a rear side plate. Reference numerals 51*a* and 51*b* denote a front end fence and a rear end fence (denoted by reference numeral 51 in FIG. 1). Reference numerals 53*a* and 53*b* denote a front jogger fence and a rear jogger fence.

3.3 Processing Mechanism

Figure 6:
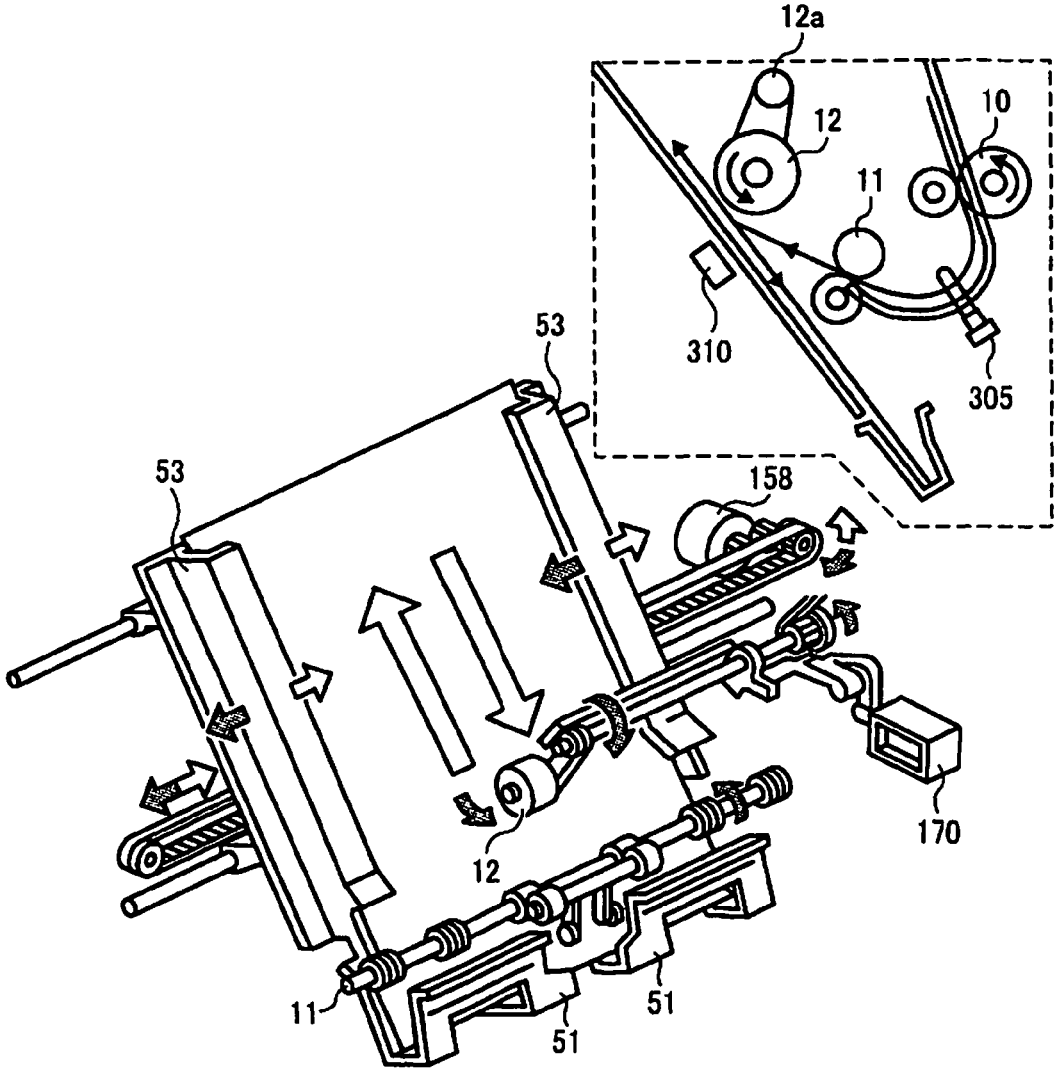
FIG. 6 is a perspective view of a configuration of the end-surface-binding processing tray for performing the stapling process.

As shown in FIG. 6, the return roller 13 is given a pendulum operation by a clamp solenoid (SOL) 170 around a supporting point 12*a*, and intermittently works the sheets sent to the end-surface-binding processing tray F, thereby butting the rear end of the sheets to the rear-end fence 51. The return roller 13 rotates in a counterclockwise direction. The jogger fences 53 are provided at the front and at the back as a pair, as shown in FIG. 5, and are driven by a jogger motor 158 rotatable in the forward and backward directions, via a timing belt, and reciprocally move in a sheet width direction.

Figure 13:
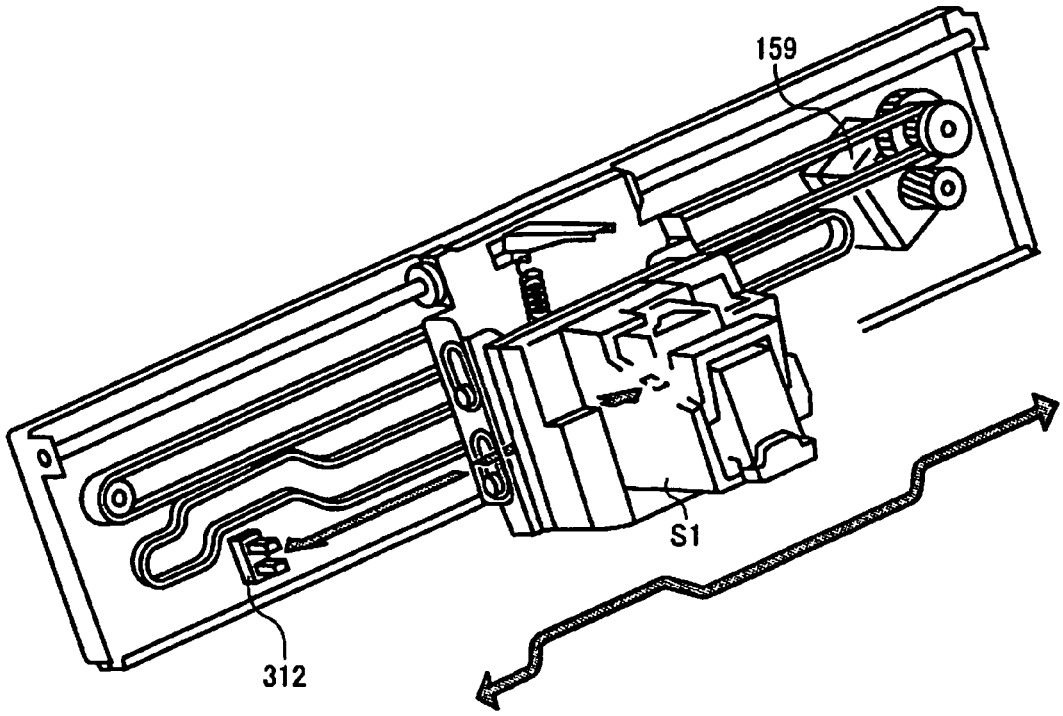
FIG. 13 is a perspective view of a configuration of an end-surface binding stapler.

As shown in FIG. 13, the end-surface binding stapler S1 is driven by a stapler moving motor 159 rotatable in the forward and backward directions, via a timing belt, and moves to a sheet width direction to bind a predetermined position of the sheet end part. The stapler-movement HP sensor 312 that detects a home position of the end-surface binding stapler S1 is provided at one end of a moving range of the end-surface binding stapler S1. A binding position in a sheet width direction is controlled by a moving amount of the end-surface binding stapler S1 from the home position.

Figure 14:
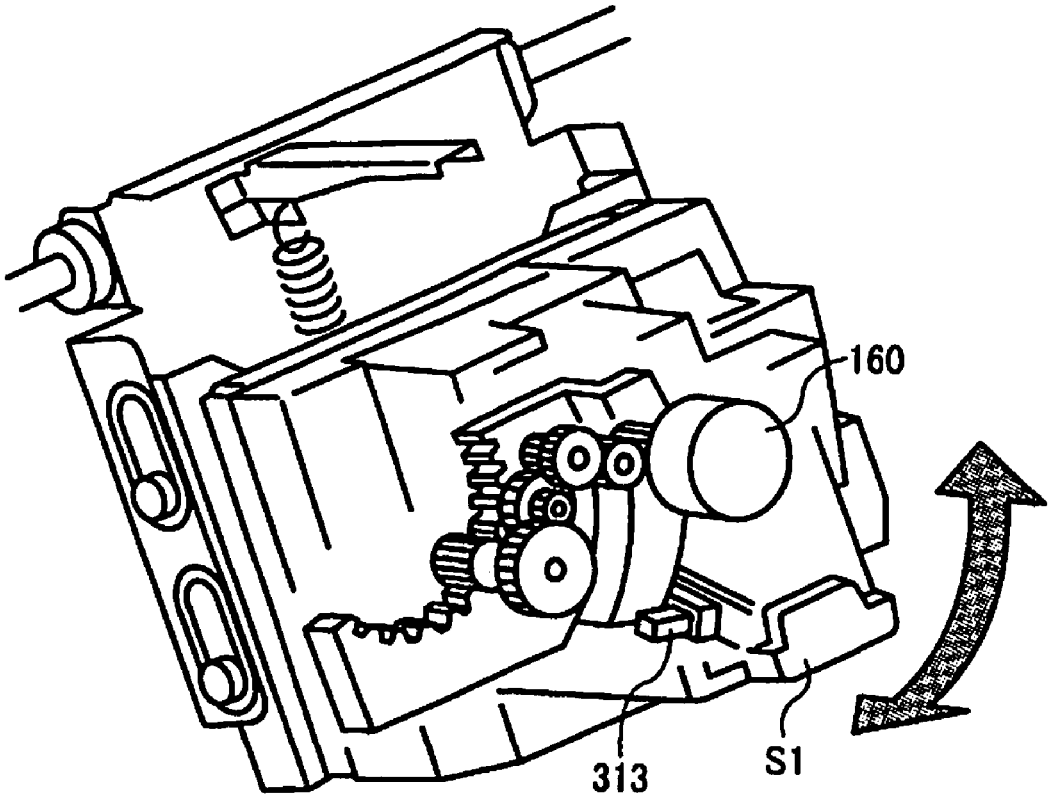
FIG. 14 is a perspective view of an oblique binding mechanism of the end-surface binding stapler.

FIG. 14 is a perspective view of an oblique binding mechanism of the end-surface binding stapler S1. The end-surface binding stapler S1 is configured to facilitate replacement of a staple needle by rotating only a binding-mechanism part of the stapler S1 by a predetermined oblique angle at the home position, to be able to change a needle stitching angle in parallel with or obliquely from the sheet end. That is, the stapler S1 rotates obliquely by an oblique motor 160. When a needle replacing-position sensor detects a predetermined oblique angle or when an oblique sensor 313 detects a reaching of the needle replacing position, the oblique motor 160 stops. When an oblique stitching ends or when the replacement of the needle is completed, the stapler S1 rotates to the original position, and prepares for the next staple. In FIG. 1 and FIG. 5, reference numeral 310 denotes a paper presence sensor that detects presence of a sheet on the end-surface-binding processing tray F.

3.4 Sheet-Bundle Rear-End Pressing Mechanism

FIGS. 7 to 11 depict a mechanism of pressing a bulge of a rear end part of a bundle of sheets stacked on the end-surface-binding processing tray F.

Figure 7:
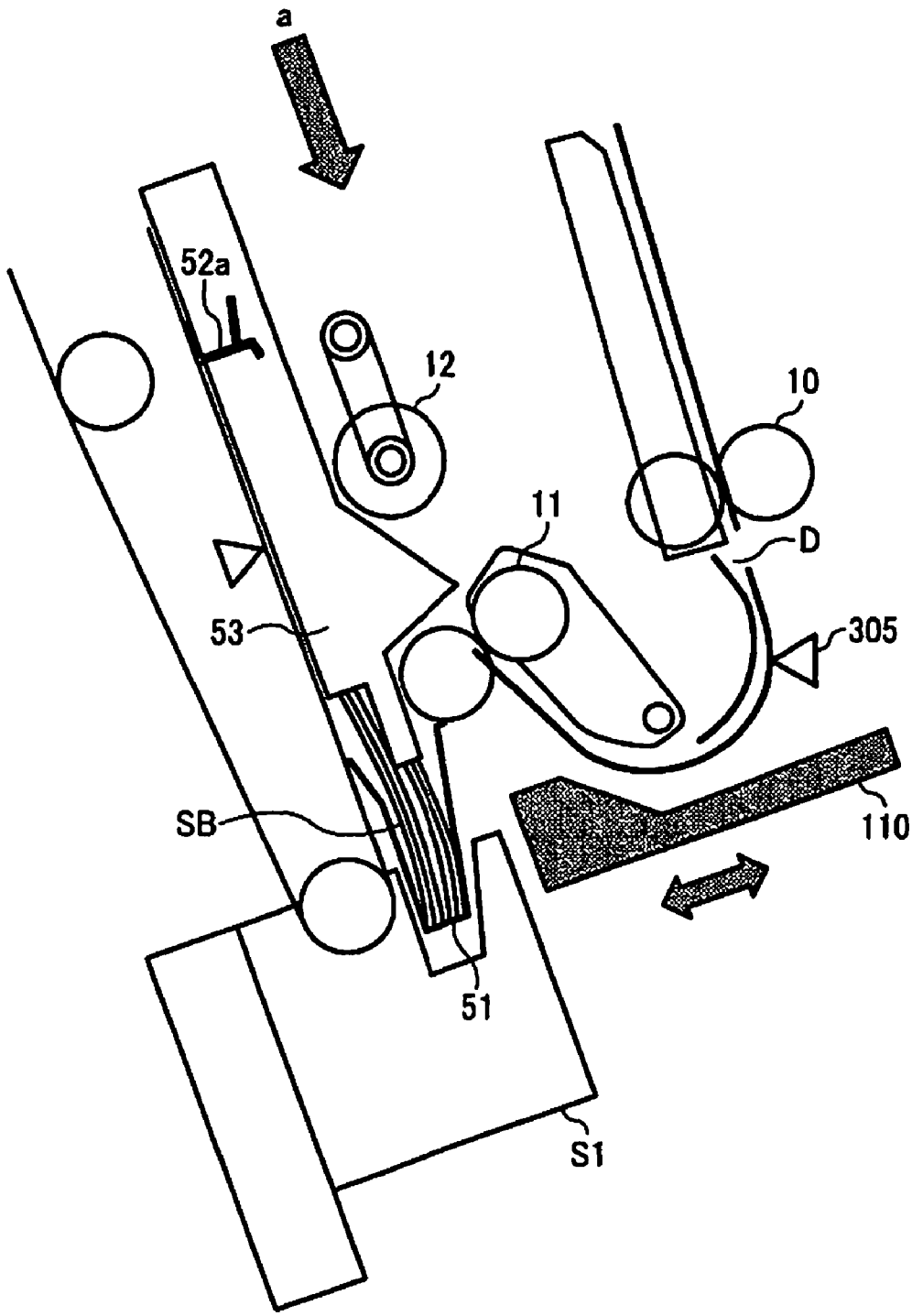
FIG. 7 depicts a mechanism for pressing a bulge of a rear end part of a bundle of sheets stacked on an end-surface-binding processing tray.

Each of the sheets discharged to the end-surface-binding processing tray F is aligned in the vertical direction (sheet carrying direction) by the return roller 13 as described above. When the rear end of the sheets stacked on the end-surface-binding processing tray F is curled or when the sheets do not have enough strength, the rear end of the sheets tends to be buckled and become a bulge. Further, when the number of stacked sheets increases, room into which the next sheet enters within the rear-end fence 51 becomes small, and the sheets are not aligned well in the vertical direction. A rear-end pressing mechanism minimizes the bulge of the rear end of the sheets, thereby facilitating the sheets to enter the rear-end fence 51. FIG. 7 is a schematic configuration diagram as a front view of the rear-end pressing mechanism. A rear-end pressing lever 110 is positioned at a lower end of the rear-end fence 51 capable of pressing the rear end of a sheet bundle SB accommodated in the rear-end fence 51. The rear-end pressing lever 110 reciprocally moves in a direction perpendicular to the end-surface-binding processing tray F.

Figure 8:
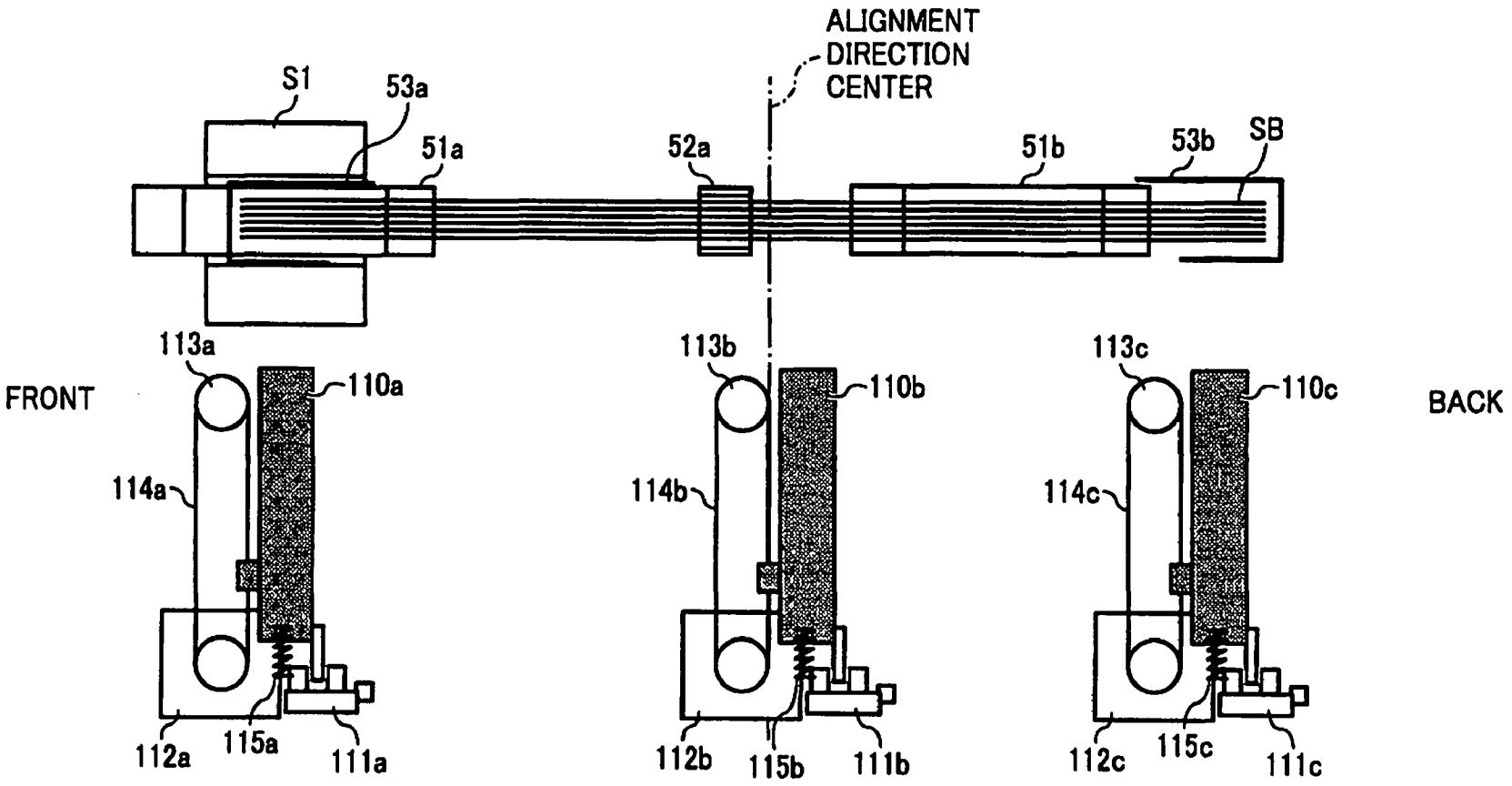
FIG. 8 is an arrow diagram of a direction a in FIG. 7.

As shown in FIG. 8, rear-end pressing levers 110*a*, 110*b*, and 110*c* pressing the rear end of the sheets stacked on the end-surface-binding processing tray F are arranged in front, at the center, and at the back of the device, respectively. A mechanism of the rear-end pressing lever 110*a* in front is explained here. First, the rear-end pressing lever 110*a* is fixed to a timing belt 114*a*. Because the timing belt 114*a* is present via a rear-end-pressing lever motor 112*a* and a pulley 113*a*, the timing belt 114*a* operates to match the rotation of the rear-end-pressing lever motor 112*a*. A convex shielding unit projected to the rear-end pressing lever 110*a* shields the home sensor 111*a*, thereby detecting a home position of the rear-end pressing lever 110*a*. The home position of the rear-end pressing lever 110*a* is set at a position not interfering with the stapler S1, within a range in which the stapler S1 moves to an arrow direction (a sheet width direction to bind a sheet end part) as shown in FIG. 13. A direction of pressing the rear end of the sheet bundle, that is, a moving amount of the rear end of the sheet bundle to the arrow direction shown in FIG. 12, is determined by the number of pulses input to the rear-end-pressing lever motor 112*a*. The rear end of the sheet bundle moves to a position of pressing the bulge of the rear end of the sheet bundle when the front end of the rear-end pressing lever 110*a* is brought into contact with the sheet bundle SB. A change of thickness of the stacked sheet bundle SB is absorbed by expansion and contraction operation of a spring 115*a*. The operation of the rear-end pressing levers 110*b* and 110*c* is the same as that of the rear-end pressing lever 110*a*. Therefore, peripheral mechanisms of the rear-end pressing levers 110*b* and 110*c* are assigned with subscripts b and c to the reference numerals like the subscript a, and explanations thereof will be omitted.

Figure 9:
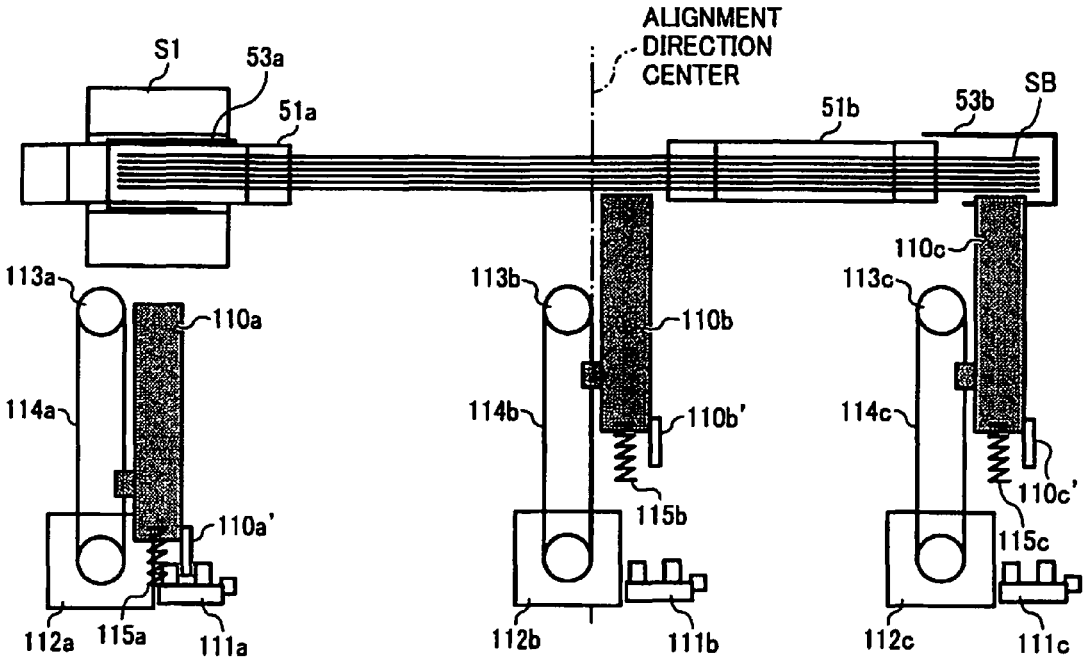
FIG. 9 depicts a relationship between an end-surface binding lever and a waiting position of a stapler at a front binding time.
Figure 10:
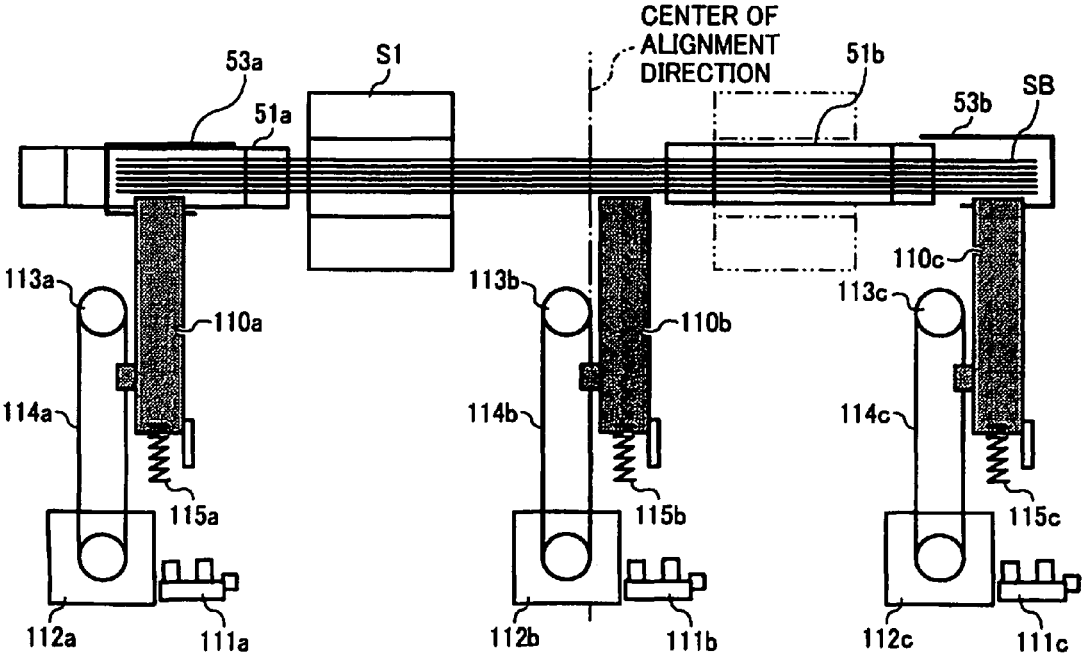
FIG. 10 depicts a relationship between an end-surface binding lever and a waiting position of a stapler at a two-point binding time.
Figure 11:
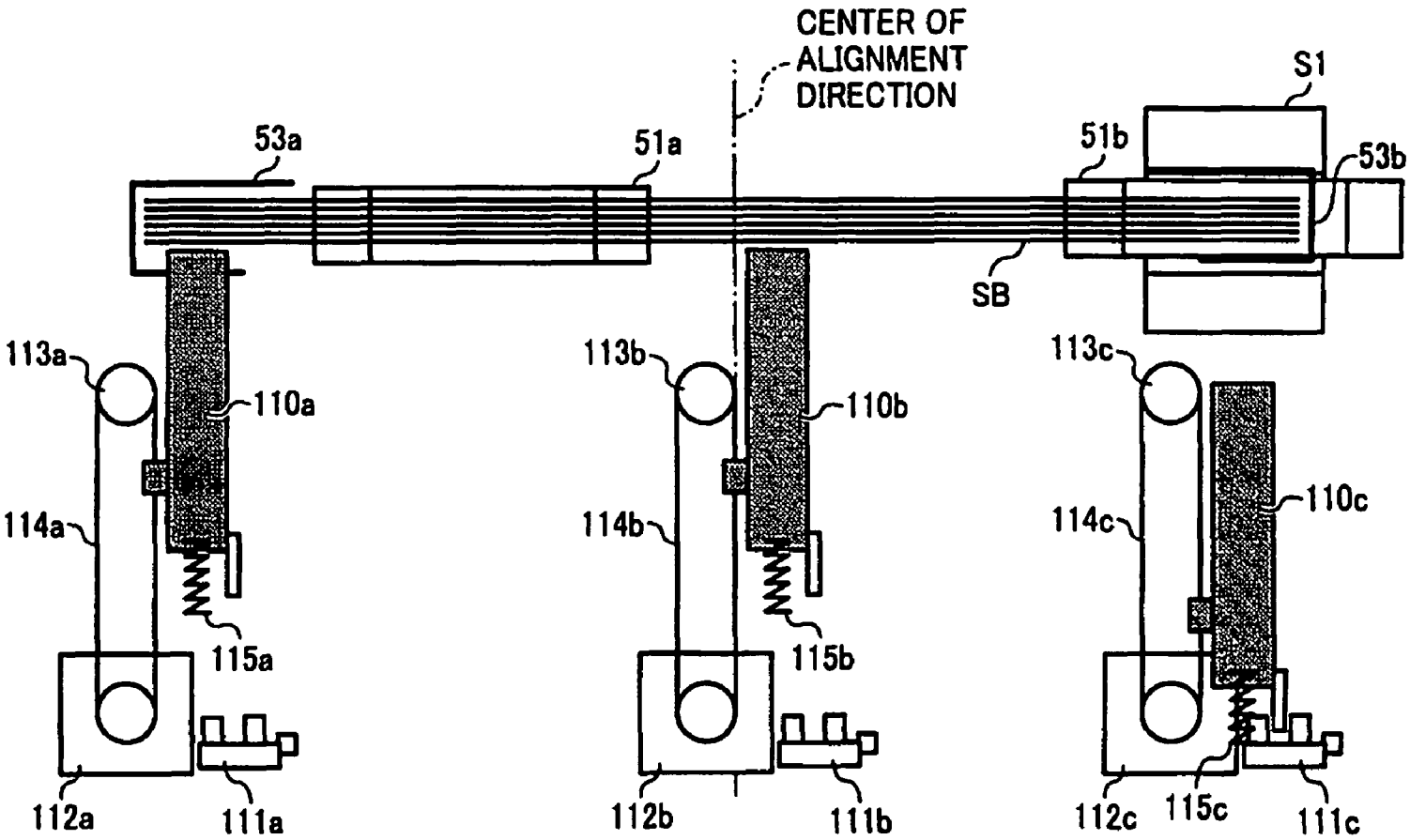
FIG. 11 depicts a relationship between an end-surface binding lever and a waiting position of a stapler at a back binding time.

Regarding a relationship between the rear-end pressing levers 110*a*, 110*b*, and 110*c* and the end-surface binding stapler S1 in each binding mode, FIG. 9 depicts a waiting position of the stapler S1 at a front binding time, FIG. 10 depicts a waiting position of the stapler S1 at a two-point binding time, and FIG. 11 depicts a waiting position of the stapler S1 at a back binding time. At each waiting position, when any one of the rear-end pressing levers 110*a*, 110*b*, and 110*c* operates, this rear-end pressing lever must not interfere with the stapler S1. In the case of the front binding shown in FIG. 9, the rear-end pressing levers 110*b* and 110*c* operate. In the case of the two-point binding, the rear-end pressing levers 110*a*, 110*b*, and 110*c* operate. In the case of the rear-end binding, the rear-end pressing levers 110*a* and 110*b* operate. FIG. 9 to FIG. 11 denote operation positions of the rear-end pressing levers in each binding mode. The operation timings of the rear-end pressing levers 110*a*, 110*b*, and 110*c* are set during a period from when the jogger fence 53 aligns the sheet width direction after the discharge sheets are stacked within the rear-end fence 51 until when the return roller 13 aligns the next sheet.

4. Sheet-Bundle Defecting Mechanism

Figure 15:
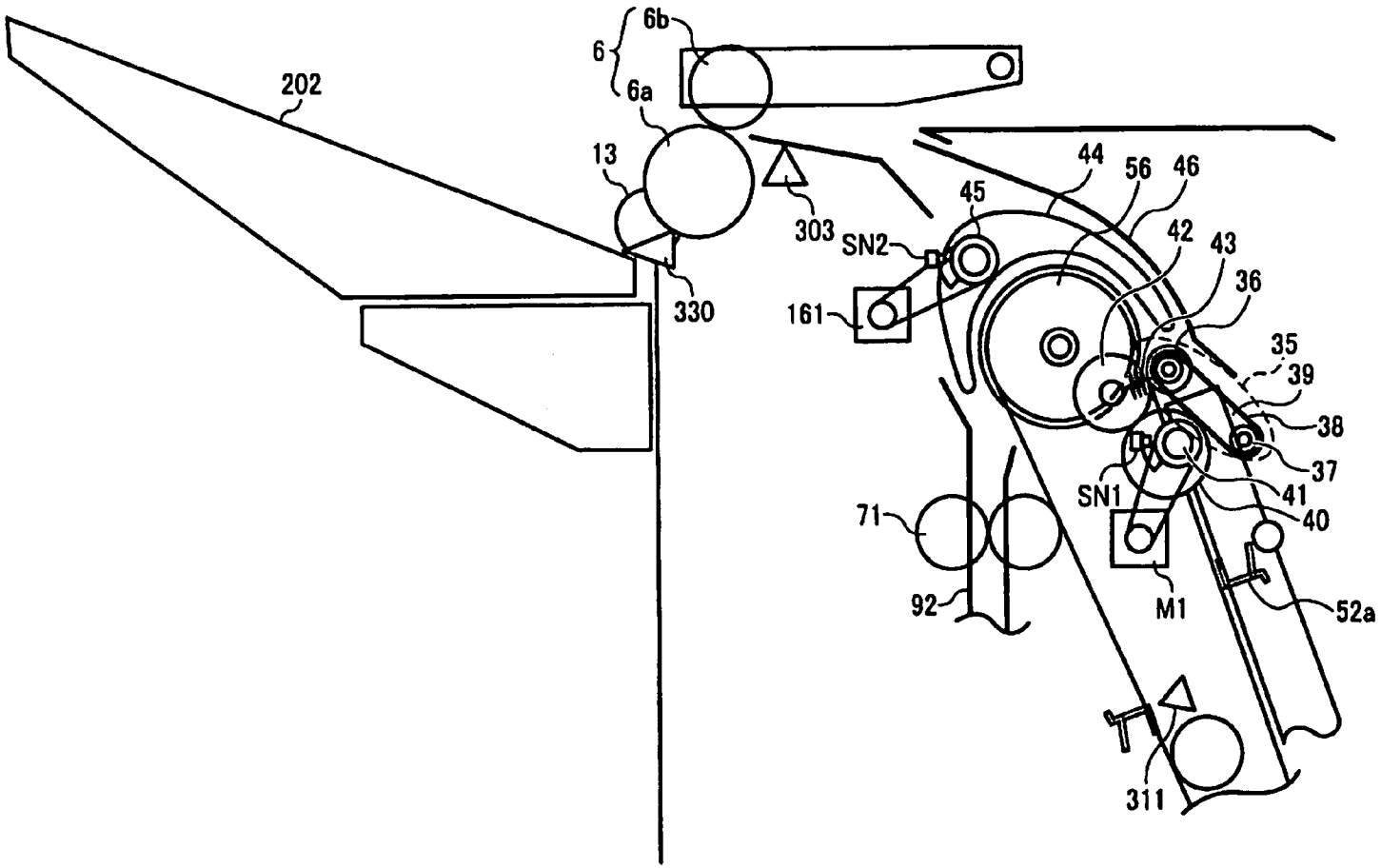
FIG. 15 depicts a sheet-bundle deflecting mechanism.

FIG. 15 depicts relevant parts of a sheet-bundle deflecting mechanism.

Figure 16A:
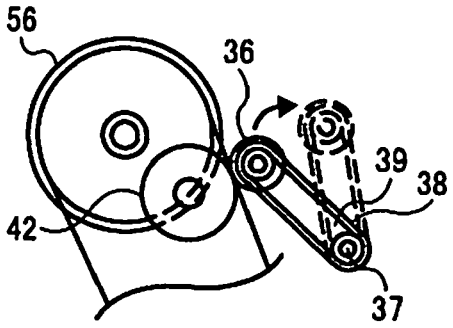
FIGS. 16A and 16B are examples of a sheet-bundle carrying mechanism in the sheet-bundle deflecting mechanism.
Figure 16B:
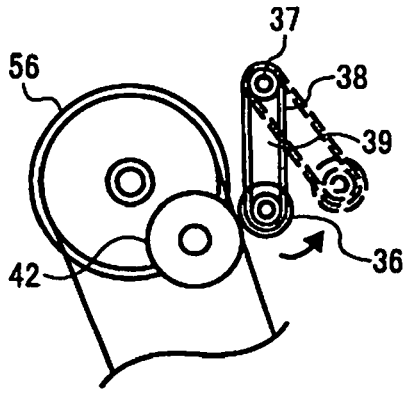

As shown in FIG. 1 and FIG. 15, a feed path that sends a sheet bundle from the end-surface-binding processing tray F to the middle-binding processing tray G or from the end-surface-binding processing tray F to the shift tray 202, and the carrying unit that carries the sheet bundle include a carrying mechanism 35 that gives carrying force to the sheet bundle, the paper discharge roller 56 that turns the sheet bundle, and the guide member 44 that guides a turn feed path 57 (FIGS. 18A and 18B) of the sheet bundle. Each unit is explained in detail. As shown in FIG. 15, driving force of a driving axis 37 is transmitted to a roller 36 of the carrying mechanism 35 by a timing belt 38. The roller 36 and the driving axis 37 are connected and supported by an arm 39, and can rotate using the driving axis 37 as a rotation supporting point. A cam 40 oscillates the roller 36 of the carrying mechanism 35. The cam 40 rotates around a rotation axis 41, and receives driving force from a motor M1. A sensor SN 1 detects a home position of the cam 40 rotating the carrying mechanism 35. A rotation angle from the home position can be controlled by increasing a sensor to a mechanism shown in FIG. 15, or can be adjusted by a pulse control of the motor M1. The carrying mechanism 35 broadly includes two configurations as shown in FIGS. 16A and 16B. That is, the driving axis 37 is arranged at the upstream of a sheet carrying direction (FIG. 16A), or is arranged at the downstream of a sheet carrying direction (FIG. 16B). A selection of a configuration depends on a layout relationship with other mechanism, and has no particular priority.

Figure 17:
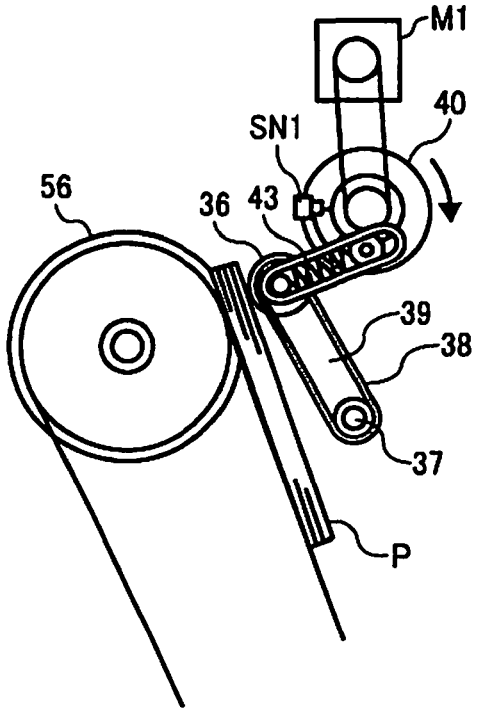
FIG. 17 is another example of a sheet-bundle carrying mechanism in the sheet-bundle deflecting mechanism.
Figure 18A:
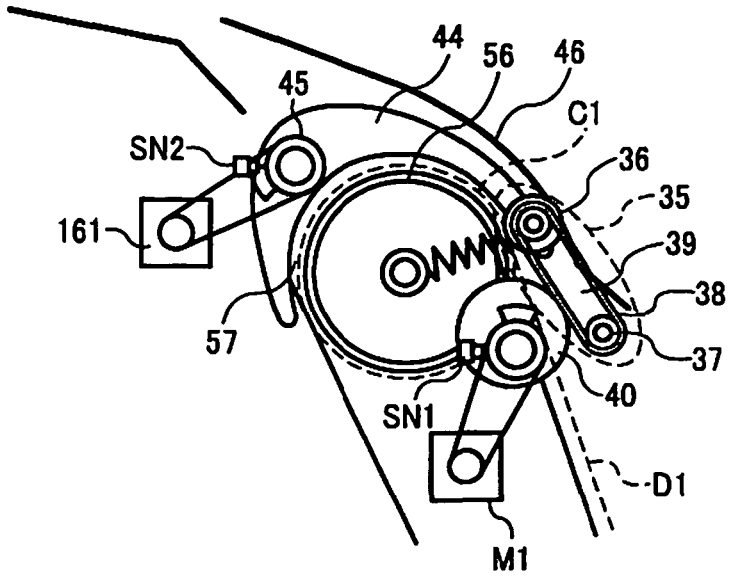
FIGS. 18A and 18B are schematic diagrams for explaining an operation of sending sheets by deflecting them by the sheet-bundle deflecting mechanism, and sending the sheets to a shift tray without deflecting them.

In the carrying mechanism 35, a driven roller 42 is arranged at an opposite position of the roller 36. The driven roller 42 and the roller 36 sandwiches a sheet bundle. An elastic member 43 applies pressure, and gives carrying force. When a thickness of a sheet bundle P increases, more carrying force, or pressing force, is necessary. Therefore, a configuration as shown in FIG. 17 is provided. The roller 36 of the carrying mechanism 35 is pressed by the cam 40 via the elastic member 43, and the pressing force can be adjusted by a pressing angle of the cam 40. As shown in FIG. 18A, a roller opposite to the roller 36 of the carrying mechanism 35 can be the paper discharge roller 56 instead of the driven roller 42. In this case, preferably, a nip position of the roller 36 and the paper discharge roller 56 is near a contact position between a bundle-carrying track line D1 and a concentric circle C1 of the paper discharge roller 56.

Figure 18B:
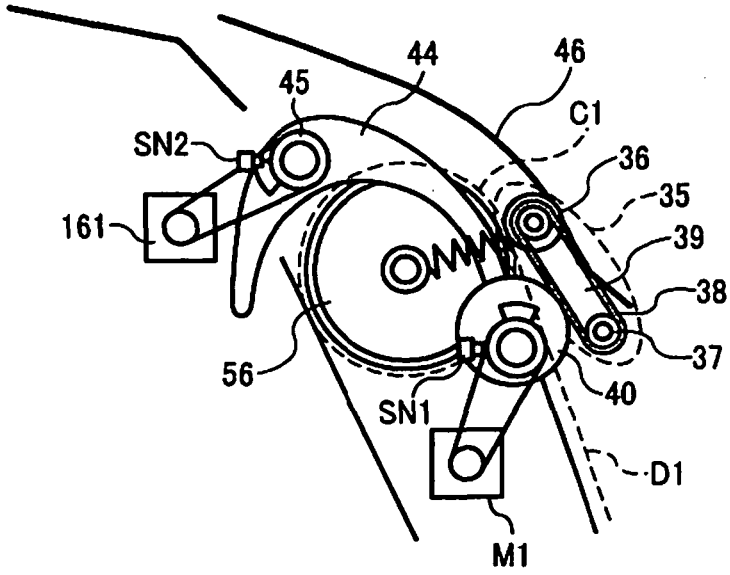

The turn feed path 57 as a feed path for feeding a sheet bundle from the end-surface-binding processing tray F to the middle-binding processing tray G includes the paper discharge roller 56 and the guide member 44 at the opposite side of the paper discharge roller 56. The guide member 44 rotates around a supporting point 45, and receives driving force from a bundle-branch driving motor 161. A sensor SN2 detects a home position of the guide member 44. A feed path for feeding a sheet bundle from the end-surface-binding processing tray F to the shift tray 202 as a stacking unit is space formed between the guide member 44 and a guide plate 46, by rotating the guide member 44 in a clockwise direction around the supporting point 45, as shown in FIG. 18B.

FIGS. 19 to 22 are schematic diagrams for explaining a basic operation of a sheet-bundle changing mechanism using the carrying mechanism 35, the guide member 44, and the paper discharge roller 56.

Figure 19:
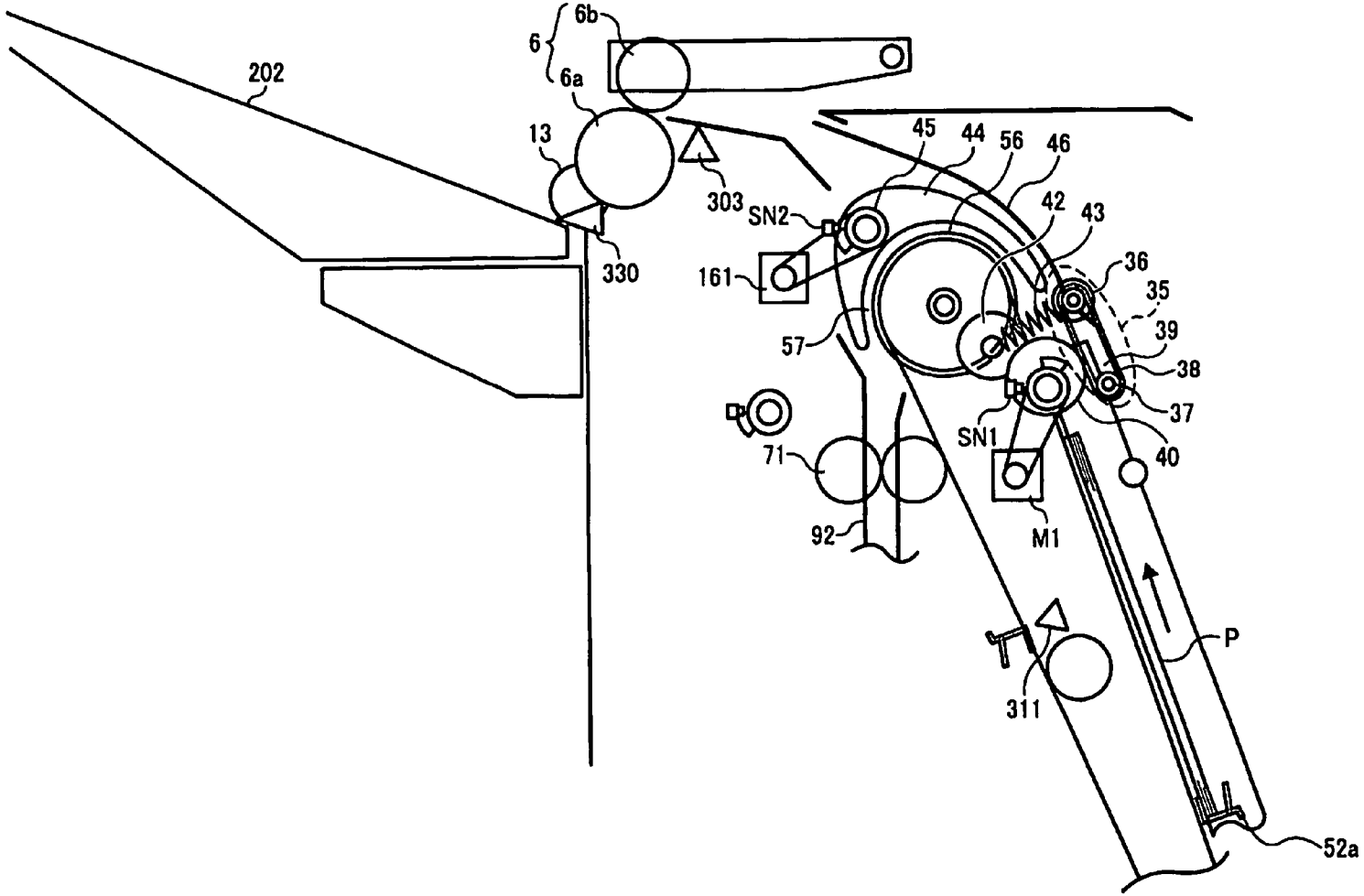
FIG. 19 depicts a state of pressing up a rear end of a bundle of sheets aligned by an end-binding processing unit, with a discharge claw.

To send the sheet bundle P from the end-surface-binding processing tray F to the middle-binding processing tray G, the rear end of the sheet bundle aligned by the end-surface-binding processing tray F is pressed up with the discharge claw 52*a* as shown in FIG. 19. The roller 36 of the carrying mechanism 35 and the opposite driven roller 42 sandwich the sheet bundle, and give carrying force. In this case, the roller 36 of the carrying mechanism waits at a position not in contact with the front end of the sheet bundle P.

Figure 20A:
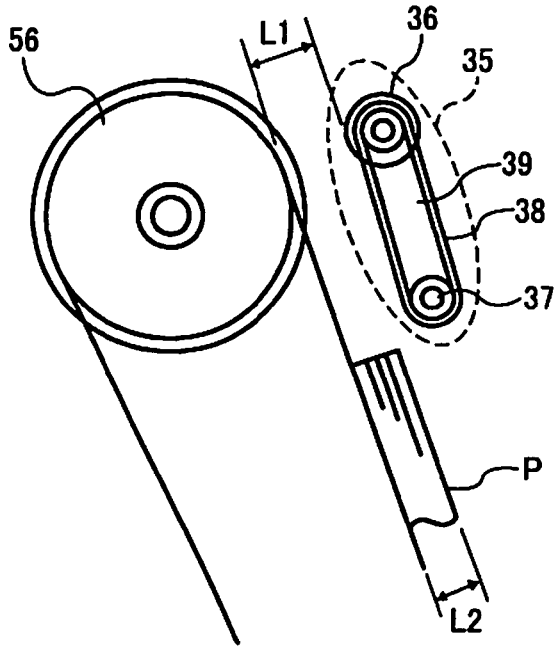
FIGS. 20A and 20B are schematic diagrams for explaining an operation of a mechanism that avoids generation of paper jam at the time of sending a bundle of sheets.
Figure 20B:
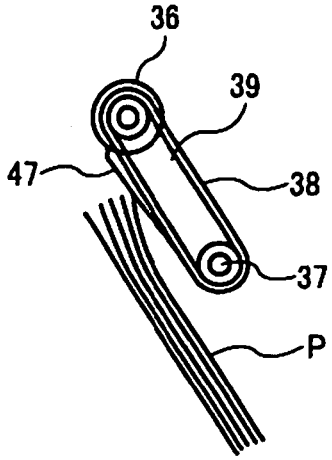

As shown in FIG. 20A, a distance L1 between the roller 36 and a surface on which the sheet bundle is stacked at the time of aligning the sheet bundle in the end-surface-binding processing tray F or a surface to which the sheet bundle P is guided at the time of pressing the sheet bundle with the discharge claw 52*a* is set larger than a maximum sheet width L2 of the sheet bundle sent from the end-surface-binding processing tray F to the middle-binding processing tray G, thereby avoiding a collision between the front end of the sheet bundle and the roller 36. In this case, a thickness of the sheet bundle changes depending on the number of sheets to be aligned on the end-surface-binding processing tray F and a sheet type (paper type). Therefore, a minimum necessary position to avoid a collision between the roller 36 and the front end of the sheet bundle P also changes. When a retracting position is changed based on the information of the number of sheets and the sheet type (paper type), a moving time from the retracting position to a position of giving carrying force can be also minimized, thereby improving productivity. The information of the number of sheets and the sheet type (paper type) can be job information from the image forming apparatus PR main body, or can be obtained by a sensor within the sheet post-processing device PD. However, when an unexpectedly large curl occurs in the sheet bundle P aligned on the end-surface-binding processing tray F, there is a risk that the sheet end is brought into contact with the roller 36 when the sheet bundle P is pressed up with the discharge claw 52*a*. Therefore, a guide 47 needs to be provided immediately in front of the roller 36 to minimize a contact angle between the sheet front and the roller, as shown in FIG. 20B. The guide 47 can be a fixed member or an elastic member to obtain the same effect.

Figure 21:
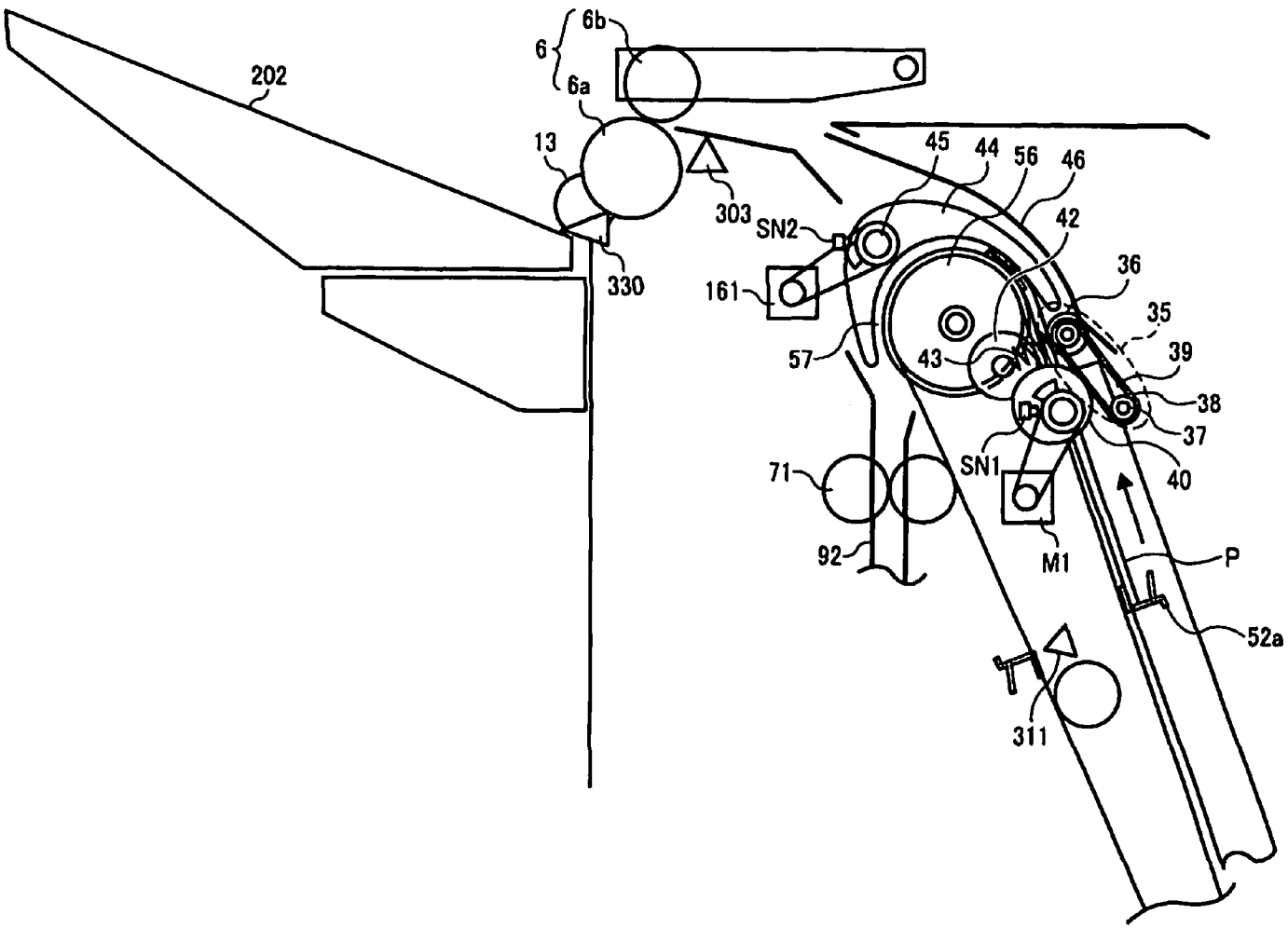
FIG. 21 is a schematic diagram for explaining an operation of giving carrying force to a carrying unit by contacting a roller of the carrying unit to a sheet surface after a sheet front end passes, at the time of deflecting a bundle of sheets.

Next, as shown in FIG. 21, after the front end of the sheet bundle P passes, the roller 36 of the carrying mechanism 35 is contacted to the sheet surface, thereby giving carrying force. In this case, the guide member 44 and the paper discharge roller 56 form a guide of the turn feed path 57, and carry the sheet bundle P to the downstream middle-binding processing tray G.

Figure 22:
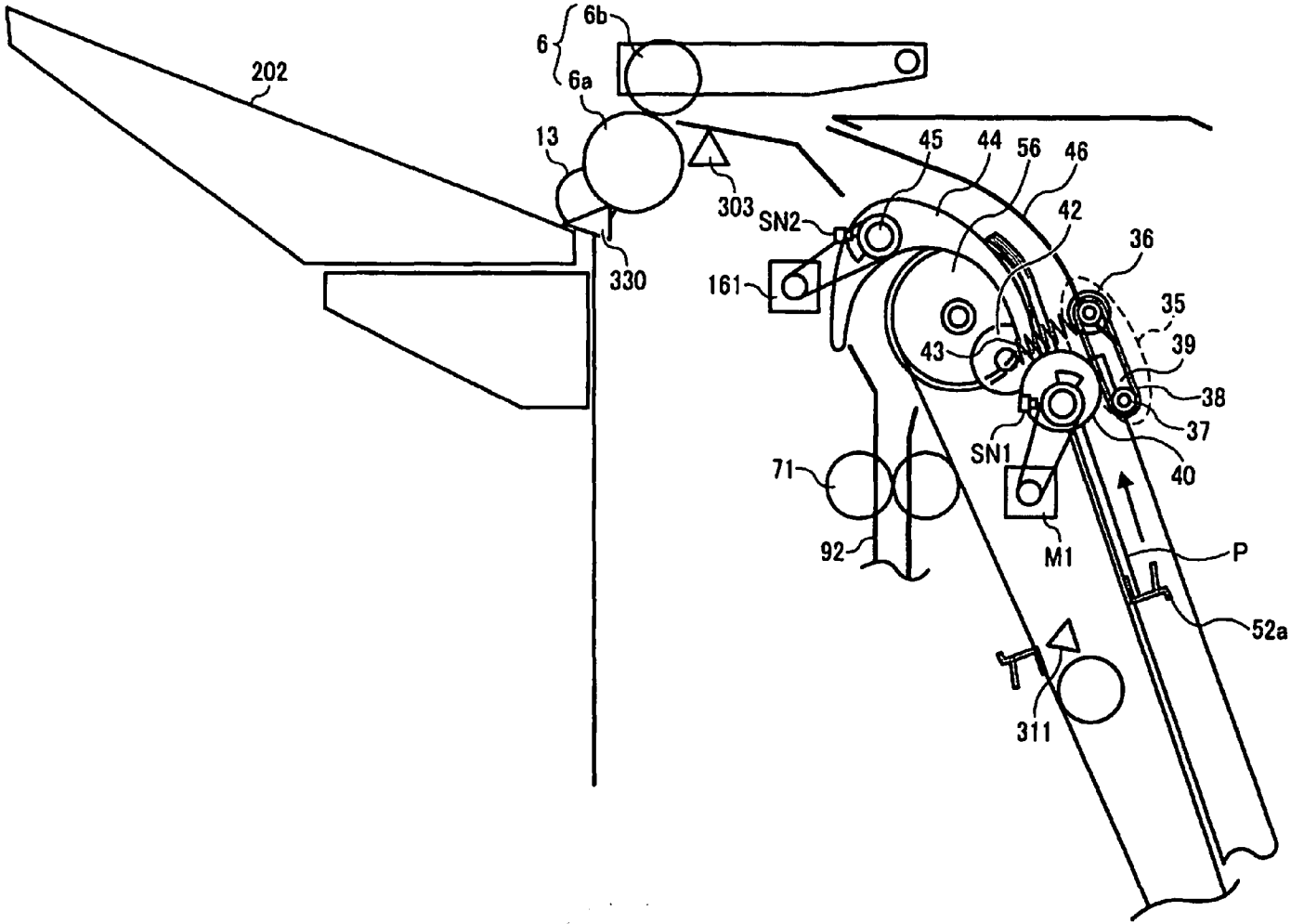
FIG. 22 is a schematic diagram for explaining an operation of forming a feed path leading to a shift tray by a guide member and a guide plate by rotating the guide member, pressing up a rear end of a bundle of sheets aligned by an end-binding processing unit, and carrying the bundle of sheets to the shift tray.

To send the sheet bundle P from the end-surface-binding processing tray F to the shift tray 202, as shown in FIG. 22, the guide member 44 is rotated to a further clockwise direction shown than an angle of sending the sheet bundle P to the middle-binding processing tray G shown in FIG. 21. The guide member 44 and the guide plate 46 form a feed path leading to the shift tray 202. The discharge claw 52*a* presses up the rear end of the sheet bundle P aligned by the end-surface-binding processing tray F, and carries the sheet bundle P to the shift tray 202. In this case, the carrying force of the roller 36 of the carrying mechanism 35 is not used.

In the present invention, the paper discharge roller 56 functions as a driven roller that follows the carrying of the sheet bundle without being restricted by the driving axis that drives the discharge belt 52. However, the paper discharge roller 56 can also function as a driving roller driven by the discharge motor 157. To make the paper discharge roller 56 function as a driving roller, the peripheral velocity of the paper discharge roller 56 is set faster than the peripheral velocity of the discharge belt 52.

5. Middle-Binding Processing Tray

Middle binding and middle folding are performed in the middle-binding processing tray G provided at the downstream of the end-surface-binding processing tray F. The sheet-bundle deflecting mechanism guides a sheet bundle from the end-surface-binding processing tray F to the middle-binding processing tray G. A configuration of the middle-binding processing tray G is explained below.

5.1 Configuration of Folding Processing Tray

As shown in FIG. 1, the middle-binding processing tray G is provided at the downstream of the sheet-bundle deflecting mechanism including the carrying mechanism 35, the guide member 44, and the paper discharge roller 56. The middle-binding processing tray G is provided substantially perpendicularly to the downstream of the sheet-bundle defecting mechanism. The middle folding mechanism is arranged at the center of the middle-binding processing tray G. A bundle-carrying-guide upper plate 92 is arranged above, and a bundle-carrying-guide lower plate 91 is arranged below. A bundle-carrying upper roller 71 is provided at an upper part of the bundle-carrying-guide upper plate 92. A bundle-carrying lower roller 72 is provided at a lower part of the bundle-carrying-guide upper plate 92. The middle-binding upper-jogger fence 250*a* is arranged at both sides along a side surface of the bundle-carrying-guide upper plate 92 to stride between both rollers 71 and 72. Similarly, the middle-binding lower-jogger fence 250*b* is arranged at both sides along a side surface of the bundle-carrying-guide lower plate 91. The middle-binding stapler S2 is arranged at a position where the middle-binding lower-jogger fence 250*b* is set. The middle-binding upper-jogger fence 250*a* and the middle-binding lower-jogger fence 250*b* are driven by a driving mechanism (not shown), and perform an alignment operation in a direction orthogonal with the paper carrying direction (a sheet width direction). The middle-binding stapler S2 is a pair of a clincher unit and a driver unit, and two pairs are provided with a predetermined interval in the sheet width direction. Although two pairs are fixed in this example, a pair of the clincher unit and the driver unit can be also moved to a sheet width direction to perform a binding at two positions.

The movable rear-end fence 73 is laid out to cross the bundle-carrying-guide lower plate 91, and can be moved to a sheet carrying direction (upper and lower direction in FIG. 1) by a moving mechanism including a timing belt and its driving mechanism. As shown in FIG. 1, the driving mechanism includes a driving pulley and a driven pulley applied with the timing belt, and a stepping motor that drives the driving pulley. Similarly, a rear-end clamp claw 251 and its driving mechanism are provided at an upper end of the bundle-carrying-guide upper plate 92. The rear-end clamp claw 251 can move reciprocally in a direction to leave from the sheet-bundle deflecting mechanism by the timing belt 252 and a driving mechanism (not shown) and in a direction to press the rear end of the sheet bundle (a side in contact with the rear end at the time of introducing the sheet bundle). In FIG. 1, reference numeral 326 denotes a home-position sensor that detects a home position of the rear-end clamp claw 251.

The middle-folding mechanism is provided at substantially a center of the middle-binding processing tray G, and includes the folding plate 74, the folding roller 81, and a feed path H for feeding the folded sheet bundle.

5.2 Folding Plate and its Operation Mechanism

FIG. 23 is a schematic diagram for explaining a moving mechanism of the folding plate 74.

The folding plate 74 is movably supported in a long-axis direction of a long hole 74*a* by movably engaging the long hole 74*a* with each two axes erected on the front and rear side plates. An axis part 74*b* and a link arm 76 are engaged with a long hole 76*b*. When the link arm 76 moves around a supporting point 76*a*, the folding plate 74 reciprocally moves to the left and right directions in FIG. 23. A long hole 76*c* is provided at the end of the opposite side of the long hole 76*b* relative to the supporting point 76*a* of the link arm 76. An axis part 75*b* of a folding-plate driving cam 75 is movably engaged in the long hole 76*c*. The link arm 76 moves based on a rotation of the folding-plate driving cam 75. The folding-plate driving cam 75 rotates in an arrow direction in FIG. 23 by the operation of a folding-plate driving motor 166. A folding-plate HP sensor 325 can determine a stop position of the folding-plate driving cam 75, by detecting both ends of a semicircle shielding unit 75*a*.

Figure 23A:
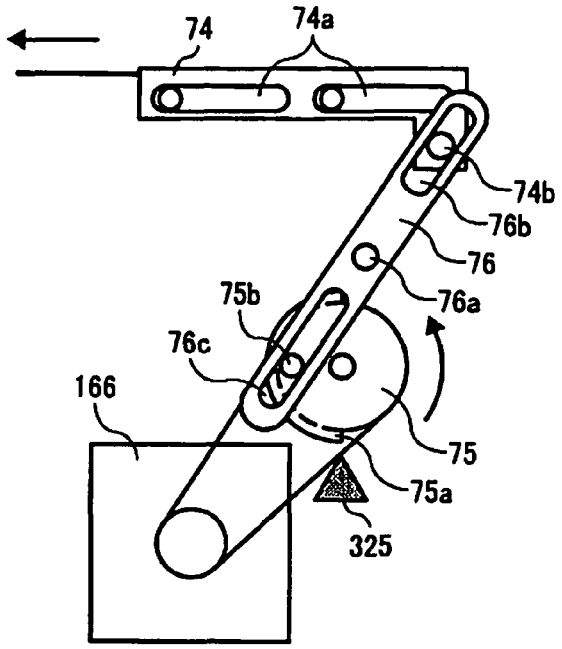
FIGS. 23A and 23B are schematic diagrams for explaining an operation of a middle folding mechanism.
Figure 23B:
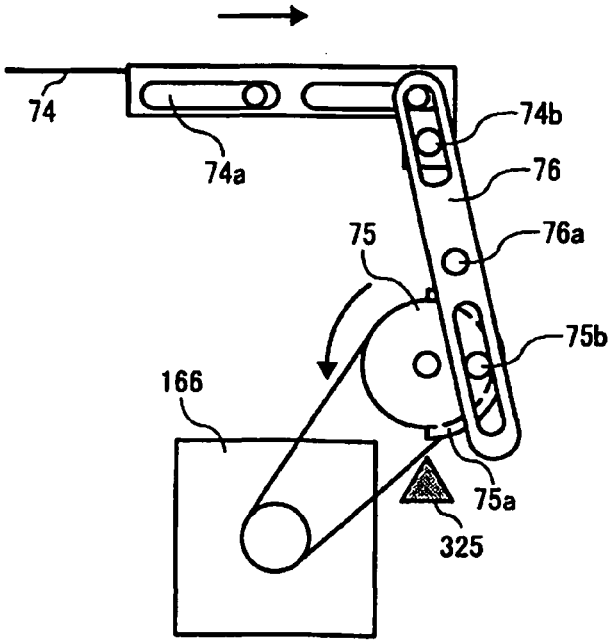
Figure 25:
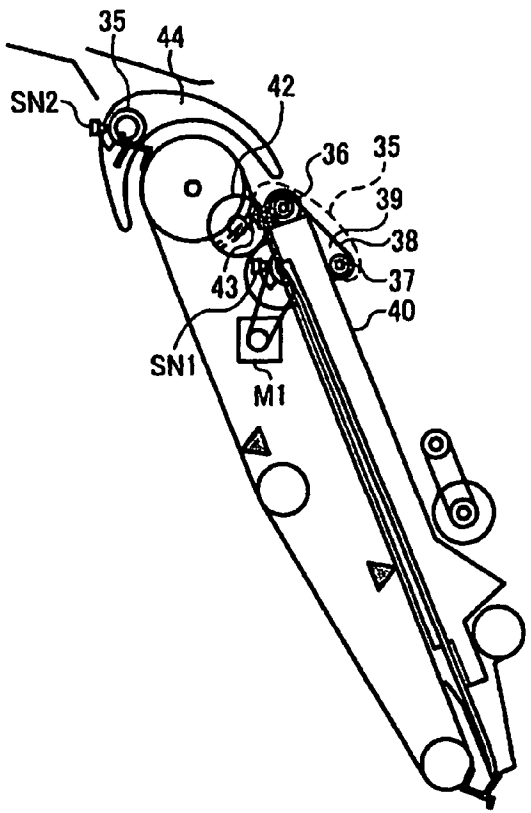
FIG. 25 depicts a state of collecting sheets in alignment on a stapling process tray.

FIG. 23A depicts a home position completely retracted from a sheet-bundle accommodation region of the middle-binding processing tray G. When the folding-plate driving cam 75 is rotated to an arrow direction, the folding plate 74 moves to the arrow direction, and is projected to the sheet-bundle accommodation region of the middle-binding processing tray G. FIG. 23B depicts a state of each unit when the center of the sheet bundle of the middle-binding processing tray G is pressed into the nip of the folding roller 81. When the folding-plate driving cam 75 is rotated to the arrow direction, the folding plate 74 moves to an arrow direction, and is retracted from the sheet bundle accommodation region of the middle-binding processing tray G.

While binding a sheet bundle is assumed for the middle folding in the present embodiment, the present invention can be also applied to folding of one sheet. In this case, when only one sheet is folded, a middle binding is not necessary. Therefore, when a sheet of paper is discharged, this sheet is sent to the middle-binding processing tray G. The folding plate 74 and the folding roller 81 perform the folding, discharge the folded sheet from a lower paper-discharge roller 83 to the lower tray 203. Reference numeral 323 denotes a folding-part passage sensor that detects a middle-folded sheet. Reference numeral 321 denotes a bundle detector that detects that the sheet bundle reaches a middle-folding position. Reference numeral 322 denotes a movable rear-end-fence home-position sensor that detects a home position of the movable rear-end fence 73.

In the present embodiment, a detecting lever 501, which detects a stacked height of the sheet bundle that is middle-folded in the lower tray 203, is movably provided at a supporting point 501*a*. A paper-surface sensor 505 detects an angle of the detecting lever 501, and detects a lifting operation and an overflow of the lower tray 203.

5.3 Mode and Discharge Pattern

In the present embodiment, the following post-processing mode is set. Sheets are discharged corresponding to this mode. The post-processing mode includes the following five modes:

a non-stapling mode a that sheets are discharged to the upper tray 201 via the feed path A and the feed path B;

a non-stapling mode b that sheets are discharged to the shift tray 202 via the feed path A and the feed path C;

a sort and stack mode in which sheets are discharged to the shift tray 202 via the feed path A and the feed path C, and at the discharge time, the shift tray 202 moves to a direction orthogonal with a paper discharge direction at each end of a part, thereby sorting the discharged sheets;

a stapling mode in which a sheet bundle is aligned and bound in the end-surface-binding processing tray F via the feed path A and the feed path D, and the sheet bundle is discharged to the shift tray 202 via the feed path C; and a middle-binding book-binding mode in which a sheet bundle is aligned and middle-bound in the end-surface-binding processing tray F via the feed path A and the feed path D, and further the sheet bundle is middle-folded in the processing tray G, and is discharged to the lower tray 203 via the feed path H. Operation of each mode is explained below.

(1) Operation of Non-Stapling Mode A

Sheets sorted by the branch claw 15 from the feed path A are guided to the feed path B, and are discharged to the upper tray 201 by the carrying roller 3 and the upper paper-discharge roller 4. An upper paper-discharge sensor 302 that is arranged near the upper paper-discharge roller 4 and detects a discharge of sheets monitors a state of the discharged paper.

(2) Operation of Non-Stapling Mode B

Sheets sorted from the feed path A by the branch claw 15 and the branch claw 16 are guided to the feed path C, and are discharged to the shift tray 202 by the carrying roller 5 and the shift paper-discharge rollers 6. The shift paper-discharge sensor 303 arranged near the shift paper-discharge rollers 6 and discharging the sheets monitors a state of the discharged paper.

(3) Operation of Sort and Stack Mode

A paper discharge operation which is the same as that in the operation (2) of non-stapling mode b is performed. In this case, the shift tray 202 moves in a direction orthogonal with the paper discharge direction at each end of part.

(4) Operation of Stapling Mode

The sheets sorted from the feed path A by the branch claw 15 and the branch claw 16 are guided to the feed path D, and are discharged to the end-surface-binding processing tray F by the carrying roller 7, the carrying roller 9, the carrying roller 10, and the staple paper-discharge roller 11. In the end-surface-binding processing tray F, the sheets sequentially discharged by the staple paper-discharge roller 11 are aligned. When the number of discharged sheets reaches a predetermined number, the end-surface binding stapler S1 binds the sheets. The bound sheet bundle is carried to the downstream b the discharge claw 52*a*, and is discharged to the shift tray 202 by the shift paper-discharge rollers 6. The shift paper-discharge sensor 303 arranged near the shift paper-discharge rollers 6 and discharging the sheets monitors a state of the discharged paper.

(4-1) Discharge Process after Stapling

When a stapling mode is selected, as shown in FIG. 6, the jogger fence 53 moves from a home position, and waits at a waiting position at one side of the sheets, with a 7-millimeter distance from the sheets discharged to the end-surface-binding processing tray F. When the sheets are carried by the staple paper-discharge roller 11 and when the sheet end passes a staple paper-discharge sensor 305, the jogger fence 53 moves to the inside by 5 millimeters from the waiting position, and stops there. The staple paper-discharge sensor 305 detects a passing of the rear end of the sheets when the rear end passes. A detection signal is input to the CPU 360 (see FIG. 33). The CPU 360 counts an oscillation pulse number from a staple carrying motor (not shown) that drives the staple paper-discharge roller 11 from the reception time of the signal. The CPU 360 turns on the clamp SOL 170 after transmitting a predetermined pulse. The return roller 13 performs a pendulum operation by turning on and off the clamp SOL 170. When the clamp SOL 170 is on, the return roller 13 clamps the sheets to return the sheets to a lower direction, and butts the sheets against the rear-end fence 51 to align the sheet. In this case, each time when the sheets accommodated in the end-surface-binding processing tray F pass the entrance sensor 101 or the staple paper-discharge sensor 305, a signal of the passing is input to the CPU 360, and the number of sheets is counted.

After a lapse of a predetermined time since the clamp SOL 170 is turned off, the jogger fence 53 moves to the inside by further 2.6 millimeters by the jogger motor 158, and stops once, thereby ending the lateral alignment of the sheets. Thereafter, the jogger fence 53 moves to the outside by 7.6 millimeters, returns to a waiting position, and waits for the next sheet. This operation is repeated to the last page of the sheets. The jogger fence 53 moves again to the inside by 7 millimeters, stops at the position, and press the both ends of the bundle of sheets to be ready for stapling. Thereafter, after a predetermined time, a staple motor (not shown) operates the end-surface binding stapler S1 to perform the binding process. When two or more binding positions are assigned, the stapler moving motor 159 is driven after the binding process at one position ends. The end-surface binding stapler S1 is moved to a proper position along the sheet rear end, and a binding process of a second position is performed. When a third and subsequent positions are assigned, this operation is repeated.

When the repetition process ends, the discharge motor is driven, and the discharge belt 52 is driven. In this case, the discharge motor is also driven, and the shift paper-discharge rollers 6 start rotating to receive the bundle of sheets lifted up by the discharge claw 52*a*. In this case, the jogger fence 53 is controlled differently depending on the sheet size and the number of binding sheets. For example, when the number of binding sheets is smaller than a set number or when the sheet size is smaller than the set size, the discharge claw 52*a* carries the sheets by catching the rear end of the sheets while the jogger fence 53 presses the sheet bundle. The paper presence sensor 310 or the discharge-belt HP sensor 311 performs the detection. After a predetermined number of pulses, the jogger fence 53 is retracted by 2 millimeters, thereby canceling the binding of the sheets by the jogger fence 53. This predetermined pulse is set during a period from when the discharge claw 52*a* is in contact with the sheet rear end until when the discharge claw 52*a* passes the front end of the jogger fence 53. When the number of binding sheets is larger than the set number or when the size of the sheets is larger than the set size, the jogger fence 53 is retracted by 2 millimeters in advance, thereby discharging the sheets. In either case, when the sheet bundle passes the jogger fence 53, the jogger fence 53 further moves to the outside by 5 millimeters, and returns to the waiting position to prepare for the next sheet. The binding force can be adjusted based on a distance of the jogger fence 53 from the sheets.

(5) Operation of Middle-Binding Bookmaking Mode

Figure 24:
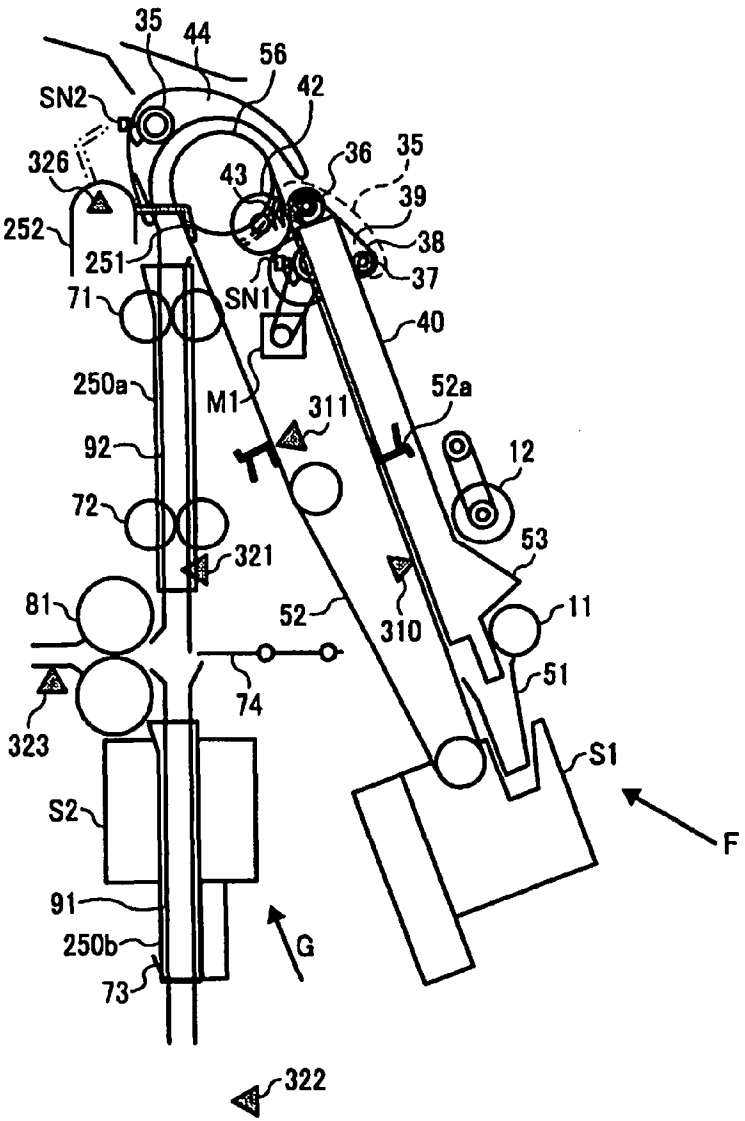
FIG. 24 is a front view of an end-surface-binding processing tray and a middle-binding processing tray.

FIG. 24 is a front view of the end-surface-binding processing tray F and the middle-binding processing tray G. FIG. 25 to FIG. 32 are schematic diagrams for explaining an operation of the middle-binding book-binding mode.

In FIG. 1, the sheets sorted by the branch claw 15 and the branch claw 16 from the feed path A are guided to the feed path D. The sheets are discharged to the end-surface-binding processing tray F shown in FIG. 24 by the carrying roller 7, the carrying roller 9, the carrying roller 10, and the staple paper-discharge roller 11. In the end-surface-binding processing tray F, the staple paper discharge roller 11 align the sheets sequentially discharged in the same manner as that in the stapling mode explained in (4) above. The operation up to immediately before the stapling is similar to that in the stapling mode (See FIG. 25, which depicts a state that the sheet bundle is aligned by the rear-end fence 51).

Figure 27:
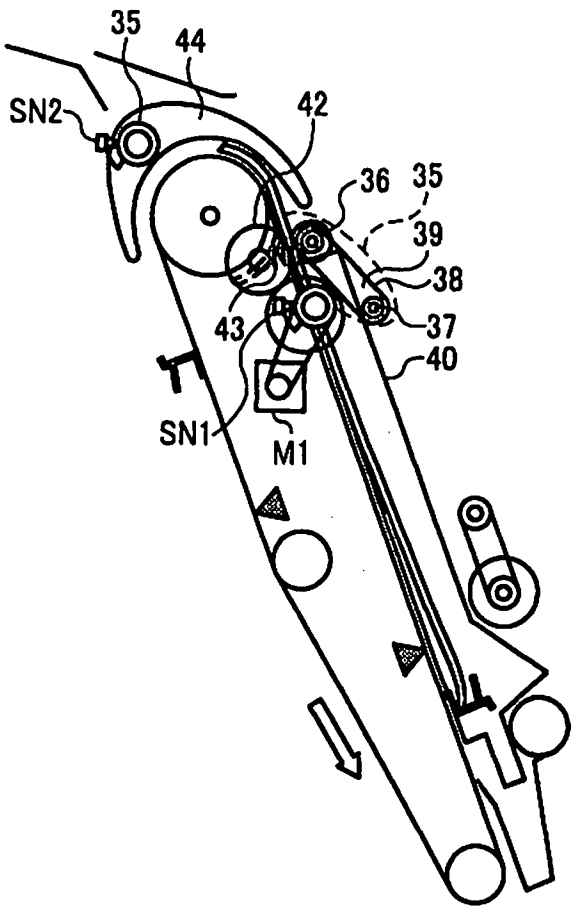
FIG. 27 depicts an initial state of introduction to a sheet deflecting mechanism from the state shown in FIG. 26.
Figure 26:
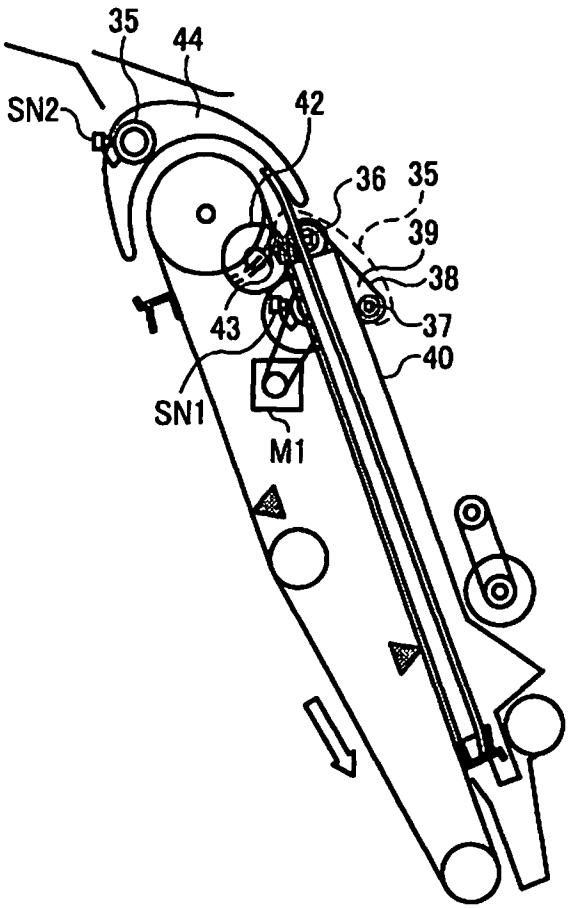
FIG. 26 depicts a state of starting a pressing up of a bundle of sheets with a discharge claw from the state shown in FIG. 25.

After the sheet bundle is provisionally aligned in the end-surface-binding processing tray F, the discharge claw 52*a* presses up the front end of the sheet bundle as shown in FIG. 26. The sheet bundle passes the roller 36 and the driven roller 42 opened in a distance not interfering with the front end of the sheet bundle. The sheet bundle proceeds to a position where the inner surface of the guide member 44 faces the external peripheral surface of the paper discharge roller 56. The roller 36 is closed by the motor M1 as an oscillation driving mechanism and the cam 40. The front end of the sheet bundle is sandwiched between the roller 36 and the driven roller 42 at a predetermined pressure. The roller 36 rotates by obtaining driving force from the timing belt 38, and is carried to the downstream along a path guided to the middle-binding processing tray G as shown in FIG. 27 by the rotation of the paper discharge roller 56. The paper discharge roller 56 is provided in the driving axis of the discharge belt 52, and is driven synchronously with the discharge belt 52.

Figure 29:
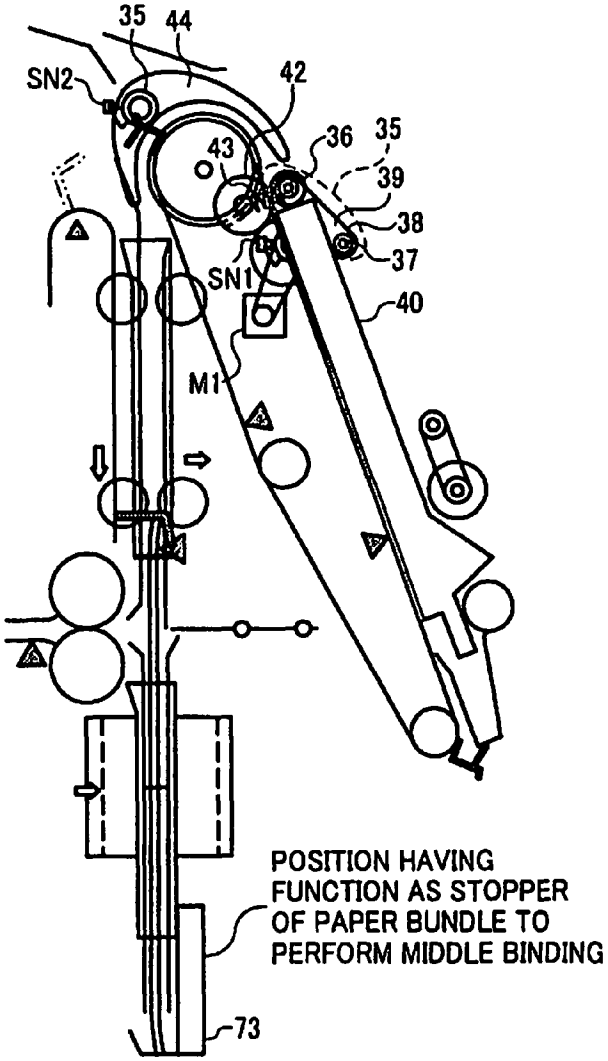
FIG. 29 depicts a state of aligning a bundle of sheets carried to the middle-folding processing tray from the state shown in FIG. 28.
Figure 28:
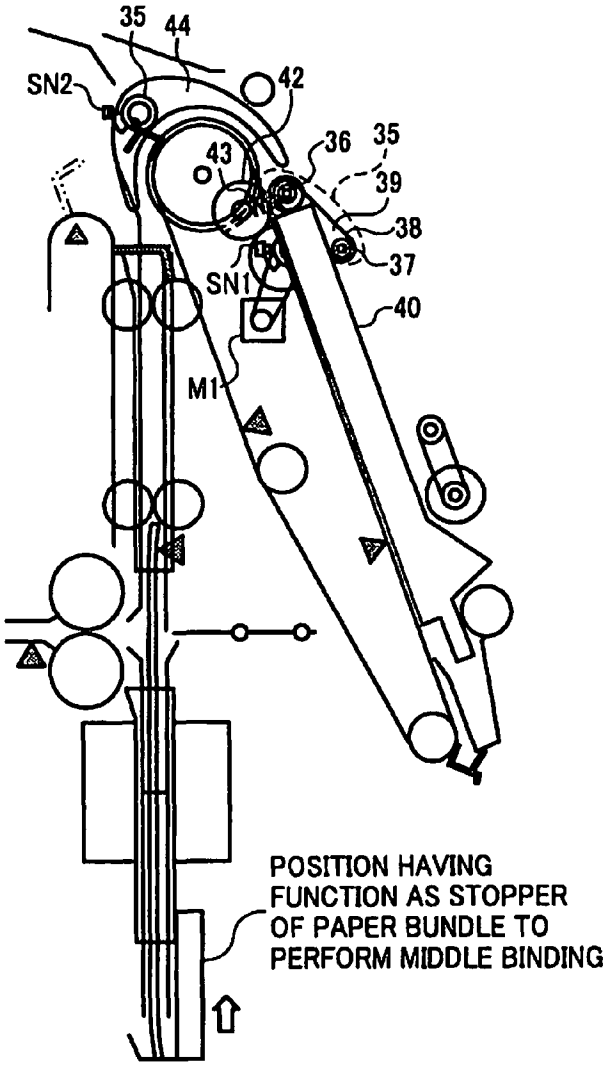
FIG. 28 depicts a state of carrying a bundle of sheets to a middle-folding processing tray from the state shown in FIG. 27.

The sheet bundle is carried from a position shown in FIG. 27 to a position shown in FIG. 28. After the sheet bundle enters the middle-binding processing tray G, the sheet bundle is carried by the bundle-carrying upper roller 71 and the bundle-carrying lower roller 72. In this case, the movable rear-end fence 73 waits at a different position corresponding to the size of each sheet bundle in the carrying direction. When the sheets are stacked by having the front end of the sheet bundle brought into contact with the waiting movable rear-end fence 73, the pressure of the bundle-carrying lower roller 72 is cancelled as shown in FIG. 28. As shown in FIG. 29, the rear end of the sheet bundle is clamped by the rear-end clamp claw 251, thereby finally aligning the sheets in the carrying direction. This is because there is a possibility of the occurrence of a deviation in the sheet bundle until when the sheets provisionally aligned in the end-surface-binding processing tray F are stacked in the movable rear-end fence 73. The sheets need to be finally aligned by the rear-end clamp claw 251.

The position shown in FIG. 29 is a middle binding position. The movable rear-end fence 73 waits at the middle binding position. The middle-binding upper-jogger fence 250*a* and the middle-binding lower-jogger fence 250*b* finally align the sheets in the width direction. The middle-binding stapler S2 binds the center of the sheet bundle. The movable rear-end fence 73 is positioned by the pulse control from the movable rear-end-fence home-position sensor 322. The rear-end clamp claw 251 is positioned by a pulse control from the rear-end-clamp HP sensor 326.

Figure 30:
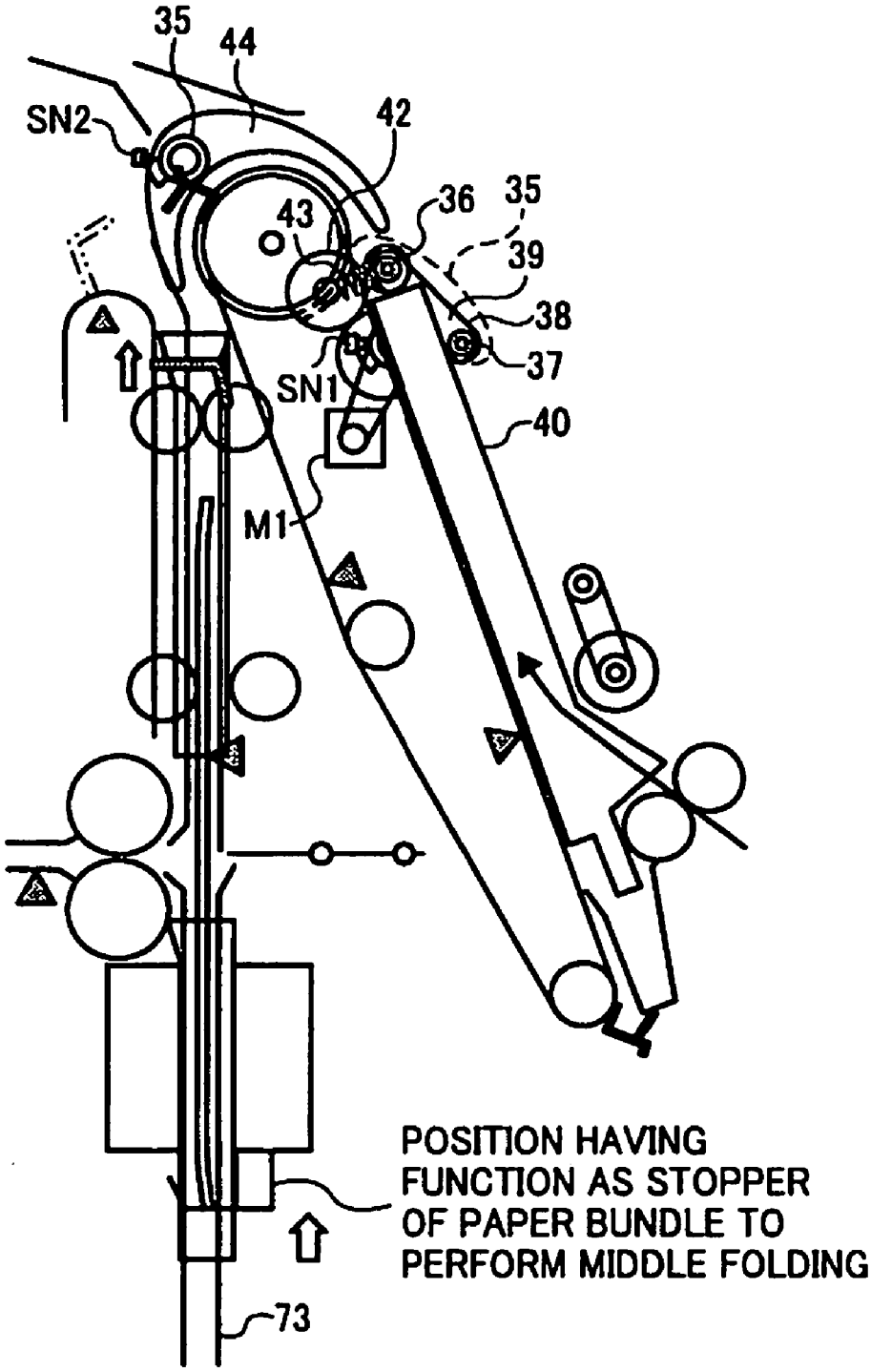
FIG. 30 depicts a state of pressing up a bundle of sheets to a middle folding position from the state shown in FIG. 29.
Figure 31:
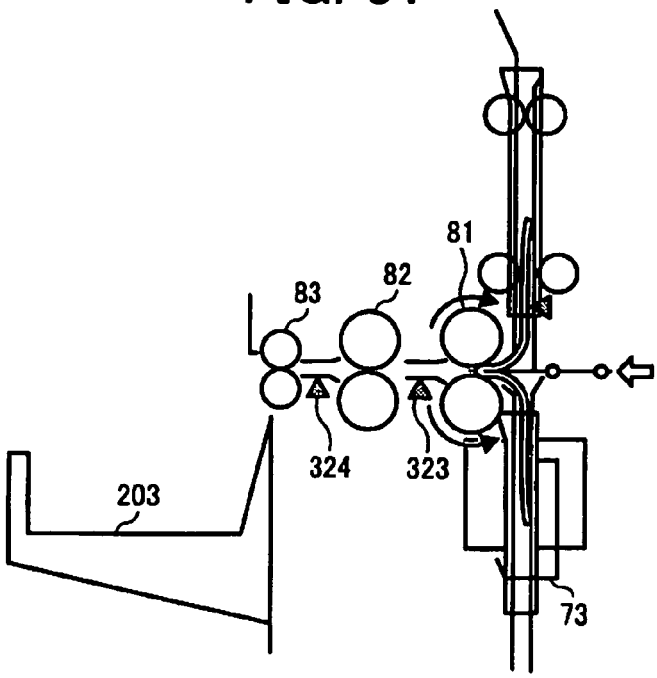
FIG. 31 depicts a state of starting middle folding from the state shown in FIG. 30.

As shown in FIG. 30, the middle-folded position of the middle-bound sheet bundle is carried upward to a position corresponding to the folding plate 74 along the movement of the movable rear-end fence 73, in the state that a pressure applied to the bundle-carrying lower roller 72 is cancelled. Thereafter, as shown in FIG. 31, the folding plate 74 presses a portion near the bound needle, in approximately a perpendicular direction. The sheet bundle is guided to the nip of the folding roller 81 arranged opposite to the proceeding direction of the folding plate 74. The folding roller 81 rotating in advance covers the sheet bundle, and carries the sheet bundle by applying pressure, thereby folding the sheet bundle at the center. When the middle-bound sheet bundle is moved upward to be folded, the sheet bundle can be securely carried by simply moving the movable rear-end fence 73. When the movable rear-end fence 73 attempts to move the sheet bundle downward to fold the sheet bundle, this cannot be done securely, and other unit such as a carrying roller is necessary. This results in a complex configuration.

Figure 32:
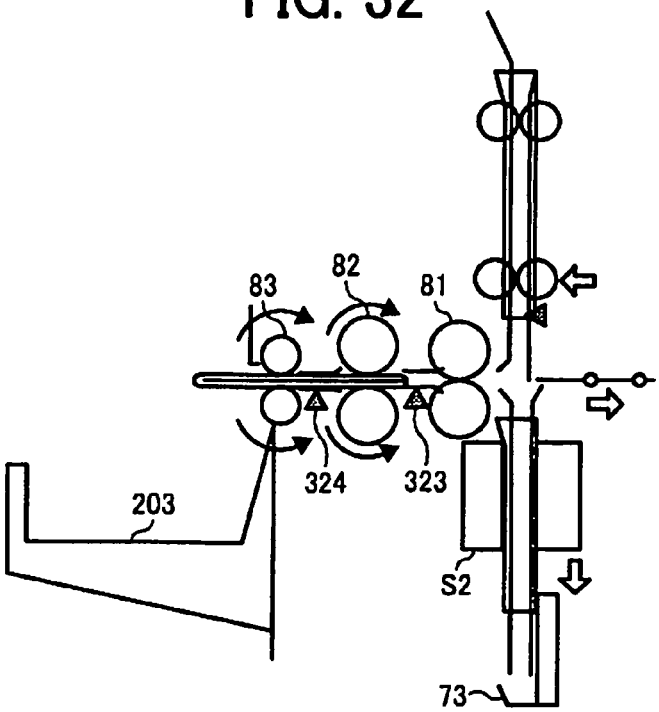
FIG. 32 depicts a state of strengthening middle folding at a folding roller position from the state shown in FIG. 31.

As shown in FIG. 32, a second folding roller 82 reinforces the folding of the folded sheet bundle. The lower paper-discharge roller 83 discharges the sheet bundle to the lower tray 203. In this case, when the folding-part passage sensor 323 detects the sheet-bundle rear end, the folding plate 74 and the movable rear-end fence 73 return to their home positions, and the pressure of the bundle-carrying lower roller 72 also returns to prepare for the next sheet. When the next job is the handling of the same sheet size and the same number of sheets, the movable rear-end fence 73 can move to the position shown in FIG. 24 again and wait there. Although the second folding roller 82 shown in FIG. 31 and FIG. 32 is not shown in FIG. 1, whether to install the second folding roller 82 is determined corresponding to a setting condition. A small cutting device can be provided as a cutting unit at the latter stage of the lower paper-discharge roller.

6. Control Circuit

Figure 33:
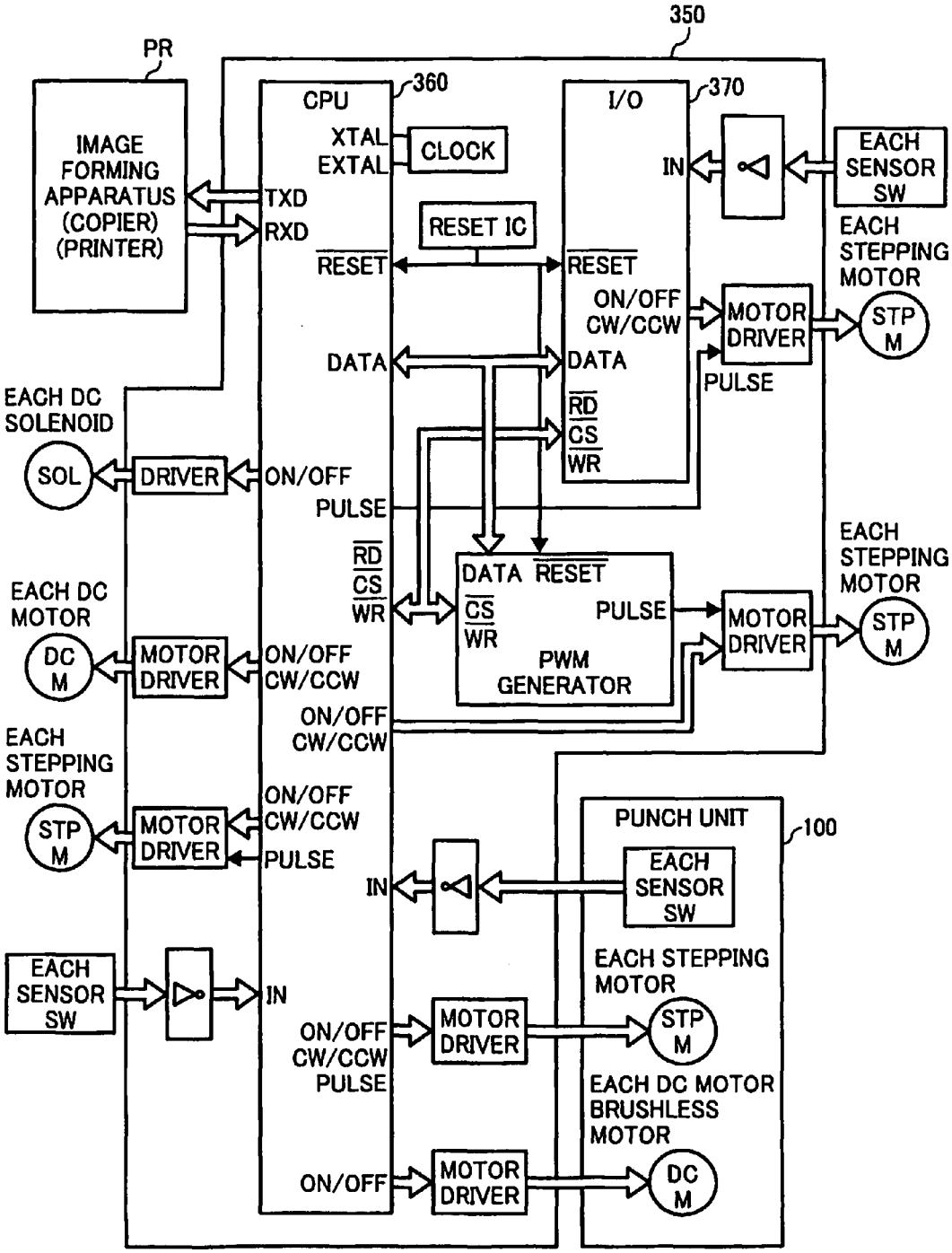
FIG. 33 is a block diagram of a control configuration of a system according to the embodiment.

FIG. 33 is a block diagram of an entire control configuration of a system according to the present embodiment. As shown in FIG. 33, the control circuit 350 of the sheet post-processing device PD is a microcomputer having the CPU 360 and an input and output (I/O) interface 370. Each switch of a control panel (not shown) of the image forming apparatus PR, and each sensor of the paper surface detector 330 input signals to the CPU 360 via the I/O interface 370. Based on the input signals, the CPU 360 controls the tray lifting motor 168 for the shift tray 202, the paper-discharge-guide-plate open motor 167 that opens and closes the open guide plate, the shift motor 169 that moves the shift tray 202, a return-roller motor that drives the return roller 13, each solenoid of the clamp SOL 170, a carrying motor that drives each carrying roller, a paper discharge motor that drives each paper discharge roller, the discharge motor 157 that drives the discharge belt 52, the stapler moving motor 159 that moves the end-surface binding stapler S1, the oblique motor 160 that rotates the end-surface binding stapler S1 in inclination, the jogger motor 158 that moves the jogger fence 53, the bundle-branch driving motor 161 that rotates the guide member 44, a bundle carrying motor that drives the paper discharge roller 56 carrying the sheet bundle, a rear-end-fence moving motor that moves the movable rear-end fence 73, the folding-plate driving motor 166 that moves the folding plate 74, and a folding-roller driving motor that drives the folding roller 81. Pulse signals of a staple carrying motor (not shown) that drives the staple-paper discharge roller are input to the CPU 360, and are counted there. The clamp SOL 170 and the jogger motor 158 are controlled corresponding to this count.

Regarding a control described later, the CPU 360 reads a program code stored in a read only memory (ROM) (not shown), develops the program in a random access memory (RAM) (not shown), and performs this control based on the program shown in the program code, using the RAM as a work area.

7. Homing Mechanism and Operation 7.1 Homing Mechanism and Operation of Shift Tray FIG. 2 depicts a shift (oscillation) mechanism of the shift tray as described above. In FIG. 2, the shift sensor 336 includes an optical transmission sensor. When light passes through two recesses 20*a* of the shift-sensor filler 20, the shift sensor 336 detects the recesses 20*a*, and sets a detected position as a home position. When the shift-sensor filler 20 is stopped in the state of detecting the recesses 20*a* of the shift-sensor filler 20, the shift tray is in the home position without operating the shift motor 169, based on the detection state of the shift sensor 336, that is, the ON state.

For example, when the power source is turned on while the shift-sensor filler 20 is stopped in the state shown in FIG. 2, even when the shift sensor 336 is in the ON state, the shift motor 169 is conventionally driven to rotate the shift-sensor filler 20, thereby once setting the shift sensor 336 to the OFF state. By returning the rotation from this position, a position where the shift sensor 336 becomes ON is set as a home position. Therefore, the home position is a position of cutting the edge of the shift sensor 336. Consequently, detection precision depends on the diameter of an optical flux of the shift sensor 336, and it is relatively high.

However, the shift tray has a stroke of about 15 millimeters to 30 millimeters. When stacked sheets or a sheet bundle can be discriminated between upper and lower sheets or between paper bundles, this is satisfactory precision. Therefore, the home position does not need to be a part where the edge of the recess 20*a* cuts the optical flux of the shift sensor 336. When the shift tray is positioned at the part of the recess 20*a*, there is no problem in performing the next control. That is, in performing the shift operation of the shift tray 202, there is no problem when the shift sensor 336 is located at any position of the width (a recess size in the circumferential direction) of the recess 20*a*.

In detecting a home position of the shift tray 202, when the shift sensor 336 is ON at the initialization time like turning on of the power source or at the time of confirming the position at the control starting time, the shift tray is assumed to be at the home position. In this case, the next control is performed without detecting the home position. A detection range of the shift sensor 336 set as the home position becomes the width of the recess 20*a*. When this width is large, a probability that the shift sensor is located at the home position is high, and the homing time included in the total control time can be shortened.

7.2 Homing Mechanism and Operation of Rear-End Pressing Lever

FIG. 8 to FIG. 11 are schematic diagrams for explaining the operation of the rear-end pressing mechanism described above. In FIG. 8 to FIG. 11, in the rear-end pressing mechanism, the convexes 110*a*' 110*b*', and 110*c*' are provided at the rear parts relative to the proceeding direction of the rear-end pressing levers 110*a*, 110*b*, and 110*c*. When the convexes 110*a*' 110*b*', and 110*c*' shield the light transmission parts of the home sensors 111*a*, 111*b*, and 111*c*, the home sensors 111*a*, 111*b*, and 111*c* detect a home position. When the home sensors 111*a*, 111*b*, and 111*c* detect the convexes 110*a*' 110*b*', and 110*c*', it is assumed that the rear-end pressing levers 110*a*, 110*b*, and 110*c* are stopped at the home position. As a result, the home position can be detected without operating the rear-end-pressing lever motor 112. In this case, the home sensors 111*a*, 111*b*, and 111*c* are not required to have high precision in detecting positions of the convexes 110*a*' 110*b*', and 110*c*'. Even when the convexes 110*a*' 110*b*', and 110*c*' are located at any position of the detection width (the detection range) of the home sensors 111*a*, 111*b*, and 111*c*, the rear-end pressing operation can be started at this position.

7.3 Homing Mechanism and Operation of Stapler

In the stapler moving mechanism shown in FIG. 13, the stapler-movement HP sensor 312 detects the home position of the end-surface binding stapler S1. The stapler-movement HP sensor 312 is not required to have high precision in punching the staple needle. When the stapler-movement HP sensor 312 is in the ON state, the next control can be performed without performing moving again or re-detection, by assuming the detected position as a home position.

7.4 Homing Operation Control

Figure 34:
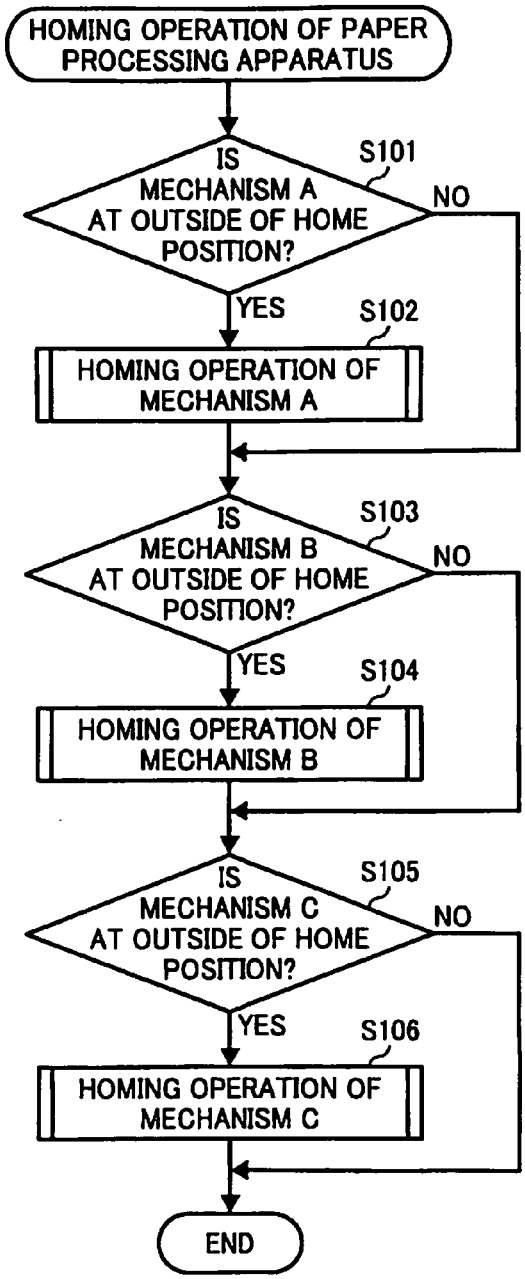
FIG. 34 is a flowchart of an operation procedure of a homing operation of a sheet processing device according to the embodiment.

As explained above, in the present embodiment, in performing the homing of each of the members, the homing operation is not performed for members of which home position state is detected by a home position sensor as the home position detecting unit. The homing operation is performed for only the members of which non-home position state is detected. FIG. 34 is a flowchart of an operation procedure of the homing operation.

FIG. 34 is a flowchart of the homing operation of the sheet processing device. In FIG. 34, when there are plural mechanisms A, B, and C, the home sensor detects parts of the mechanisms to be detected, in the order of the mechanisms A, B, and C, and determines whether the mechanism is at the home position (step S101). When the mechanism is outside the home position, the sheet processing device performs the homing (step S102). When the mechanism is at the home position, the sheet processing device does not perform the homing, and determines whether the next mechanism B is at the home position (step S103). Operations similar to those at step S101 and step S102 are performed. The sheet processing device performs a home-position detection operation of the next mechanism C (steps S103 to S106), and ends the process. While only the mechanisms A, B, and C are shown as an example, the above process is repeated for all mechanisms to be controlled requiring the detection of a home position.

At the above steps S101, S103, and S105, when an abnormal state of a mechanism is detected in a state of detecting a home position, the power source is turned on and off to perform an abnormality return process after performing a prescribed abnormality process. However, when a home position is detected, paper feeding is started in a state of not being able to detect an abnormality, because the homing operation or abnormality detection is not performed although a mechanism abnormality is not solved yet.

Figure 35:
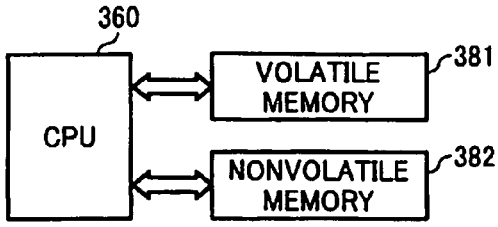
FIG. 35 is a block diagram of a configuration of an abnormality detecting unit according to the embodiment.

In the present embodiment, an abnormality detecting unit is provided to detect an abnormal state of the various mechanisms. The abnormality detecting unit includes at least a function of detecting an abnormality of various mechanisms during a home-position detection operation, and an abnormality-information storing unit that stores information of the detected abnormality. At the time of performing the homing of the various mechanisms using the abnormality information stored in the abnormality-information storing unit, the abnormality detecting unit determines whether to perform the homing operation. FIG. 35 is a block diagram of a configuration of the abnormality detecting unit. The abnormality detecting unit includes the CPU 360, the volatile memory 381, and the nonvolatile memory 382. The CPU 360 detects an abnormality of the homing, and performs a motor driving control of the homing, based on sensor information input from the I/O interface 370 shown in FIG. 33, or without via the I/O interface 370. That is, the abnormality detecting unit is realized as a function of the CPU 360. This function is performed as follows. The CPU 360 reads a program code stored in a ROM (not shown), develops this program into a RAM (not shown), uses the RAM as a work area, and performs the operation along the program code. The operation of the CPU 360 can be also performed by an application specific integrated circuit (ASIC).

Figure 36:
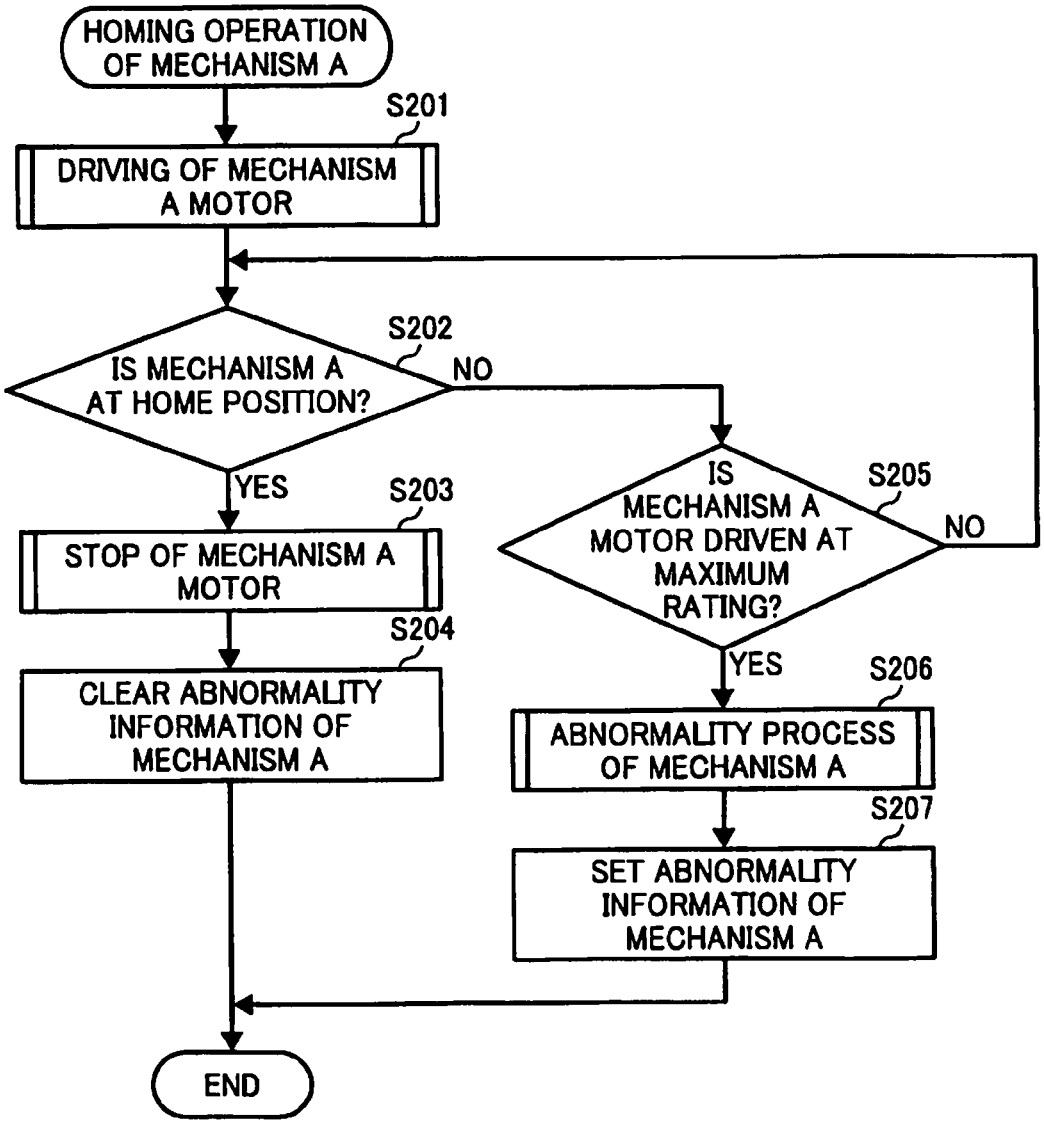
FIG. 36 is a flowchart of an operation procedure of performing an abnormality process by performing abnormality detection during a homing operation and during a paper processing operation according to the embodiment.

FIG. 36 is a flowchart of an operation procedure of the CPU 360 in performing the abnormality process by detecting the abnormality during the homing operation and the paper processing operation. In FIG. 36, the CPU 360 drives a motor that performs homing during the homing operation of the mechanism A (step S201). Next, the homing sensor checks whether the mechanism A is located at the home position (step S202). When the mechanism A is at the home position, the motor is stopped (step S203), and the abnormality information of the mechanism A is cleared (step S204).

Figure 37:
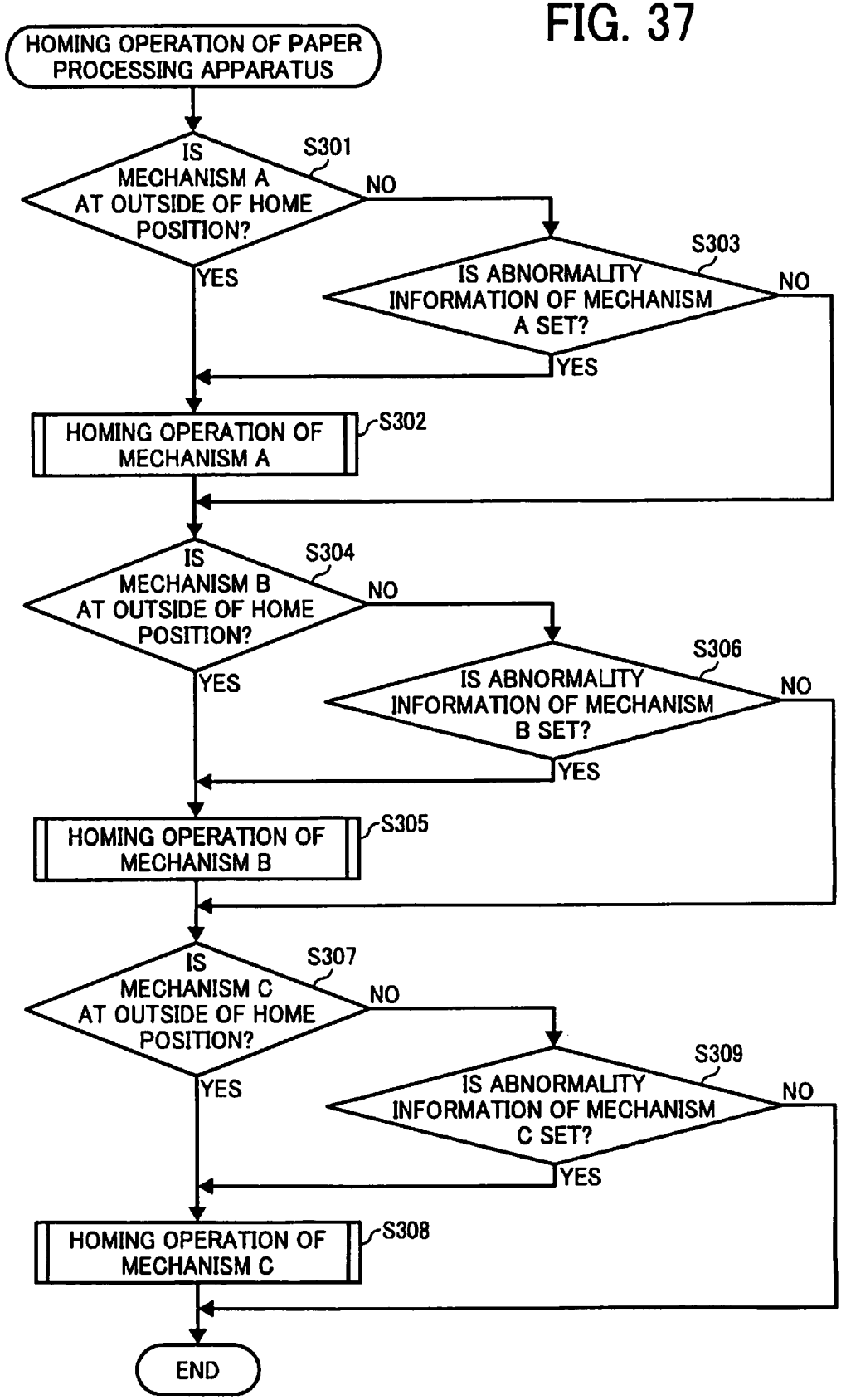
FIG. 37 is a flowchart of an operation procedure of performing a homing operation regardless of a home position state when an abnormality occurs in the operation immediately before, by referencing abnormality information according to the embodiment.

On the other hand, when the mechanism A is not at the home position at step S202, the CPU 360 drives the motor that drives the mechanism A, to a maximum rate (YES at step S205), and performs the abnormality process of the mechanism A (step S206). When an abnormality is detected, the CPU 360 stores the abnormality information of the mechanism A into a memory (step S207). The memory is the volatile memory 381 or the nonvolatile memory 382. The abnormality information cleared at step S204 is also stored in the memories 381 and 382. When the abnormality information is stored in the memories 381 and 382, the CPU 360 references the abnormality information at the time of performing the homing of the mechanism. When an abnormality occurs in the operation immediately before, the CPU 360 performs the homing operation regardless of a home-position state. FIG. 37 is a flowchart of the operation procedure.

In FIG. 37, in this operation procedure, the CPU 360 checks whether the mechanism A is at the home position, in performing the homing of the sheet processing device (step S301). When the mechanism A is not at the home position, the CPU 360 performs the homing operation (step S302). When the mechanism A is at the home position (NO at step S301), the CPU 360 checks whether the abnormality information of the mechanism A is set to the memory (step S303). When the abnormality information of the mechanism A is set to the memory, the CPU 360 performs the homing at step S302. When the abnormality information of the mechanism A is not set to the memory, the CPU 360 assumes that the mechanism A is correctly located at the home position, and repeats the same operation to the next mechanism B (steps S304, S305, and S306), and further repeats the home positioning and check of abnormality of the next mechanism (steps S307, S308, and S309).

While abnormality information is stored into the memories 381 and 382 at step S207, when the abnormality information generated immediately before is stored into the volatile memory 381, the abnormality information disappears when the power source is turned off and on. Therefore, the homing operation or the abnormality detection is not performed. In the present embodiment, the abnormality information is stored into the nonvolatile memory 382.

The sheet post-processing device PD according to the present embodiment has a communication unit with a paper-carrying upstream device, that is, the image forming apparatus PR. The sheet post-processing device PD receives the information of the detected abnormality state, from a paper-carrying upstream device (the image forming apparatus PR) 380, and transmits the abnormality information. The system configuration diagram in FIG. 33 depicts a connection state of the communication (TXD: transmission, RXD: reception) with the image forming apparatus (the upstream device) 380.

7.5 Operation Timing of Homing

When the homing operation is performed, operation noise occurs because of the operation of the mechanism. Particularly, when the power source is turned on or when the cover is closed, this operation noise is unpleasant for the user. Therefore, in the present embodiment, the homing operation is performed immediately after the paper is carried or after the paper is processed. When the homing operation is performed immediately after the paper is carried or after the paper is processed, the homing operation noise is generated at the same time as the operation noise of the paper processing is generated. Accordingly, the user is little aware of the noise due to the homing operation, and does not feel unpleasant.

On the other hand, there are cases that the homing operation of the various mechanisms is long and the operation noise is unpleasant to the user, or that power consumption and parts abrasion are problematic. For example, when the home-position detection control is performed to the mechanisms A, B, and C, the time required for the homing process is different depending on the mechanism. Depending on the operation mode immediately before stopping, the operation noise of the homing becomes unpleasant. In this case, the processing order of the mechanisms A, B, and C in the flowcharts shown in FIGS. 34, 36, and 37 can be changed corresponding to the mode described in the section 5.3. With this arrangement, a relationship between the operation mode and the homing operation giving the minimum discomfort to the user can be selected based on the relationship between the operation mode and the mechanism. Further, a combination of the operation mode and the homing operation that minimizes the homing operation can be selected.

When the power source in ON for all the mechanisms, when the home sensor is in the ON state at the cover closing time, the control cannot be necessarily performed by assuming that the corresponding mechanism is at the home position. Only the detection width for assuring the home position can be set in this case. Therefore, when it cannot be recognized that the mechanism is at the home position when a part of the mechanism is detected within the set detection width, the homing operation needs to be performed at the time of turning on the power source or closing the cover of the mechanism, like conventional techniques. When the door is opened and closed many times, the homing operation also needs to be performed each time.

In this case, the homing operation is performed immediately before the paper feeding or paper processing. Accordingly, the paper feeding or paper processing is started after the homing operation. Therefore, the user recognizes the noise as the noise of a series of operation, and feels little discomfort. When the homing operation is performed immediately before starting the paper feeding or paper processing, the homing operation does not need to be performed at the time of turning on the power source or closing the cover.

Figure 38:
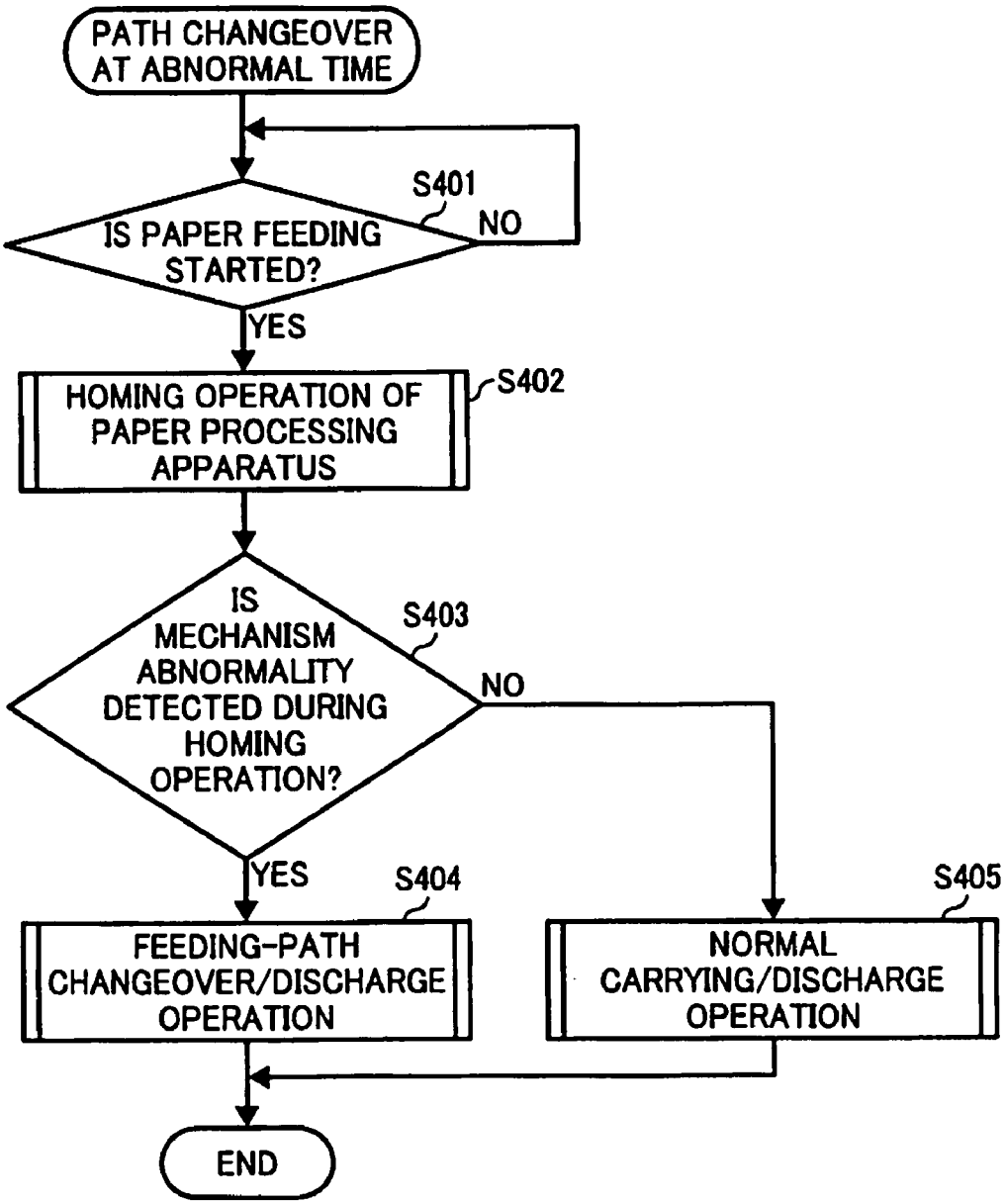
FIG. 38 is a flowchart of an operation procedure of a path changeover at an abnormal time in the embodiment.

When an abnormality of various mechanisms is detected during the detection of the home position, the feeding of paper to the mechanism where the abnormality occurs generates inconvenience such as paper jam. Therefore, when the CPU 360 (the abnormality detecting unit) detects an abnormality, paper is carried to a path different from a paper feed path in the operation mode in operation, and does not send the paper to the mechanism where the abnormality is detected. FIG. 38 depicts an operation procedure in this case. FIG. 38 is a flowchart of an operation procedure of a path changeover at an abnormal time.

In FIG. 38, the paper feeding is started (step S401), and the sheet processing device performs the homing operation (step S402). When an abnormality of the mechanism is detected during the homing operation (YES at step S403), the feed path is changed over, and the paper is discharged to the proof tray 201 (step S404). When no abnormality is detected during the homing operation, a normal paper feeding operation is performed. The paper is discharged to a predetermined tray following the feeding operation (step S405).

As a result, when a mechanism abnormality occurs during the homing operation, paper jam does not occur, and this can minimize load to the user.

While an exemplary embodiment of the present invention has been explained above, those skilled in the art will achieve various alternatives, changes, and modifications from the disclosure of the present specification, and these are embraced within the scope of the present invention defined by the appended claims.

According to an aspect of the present invention, it is possible to suppress noise, power consumption, r parts abrasion due to a homing operation, and prevent an inconvenience such as a delay in the processing operation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of detecting a home position of a moving member by detecting a part of the moving member using a detecting unit, the method comprising:

setting in advance a detection range within which the home position can be recognized;

setting, when the detecting unit detects a part to detect the home position of the moving member in a state in which the moving member is stopped, a detection position as the home position by assuming that the detection position is in the detection range without operating the moving member once to move the moving unit out of a detection range of the detecting unit, the home position being performed immediately after stopping or before starting a sheet feeding or a sheet processing;

controlling, when performing homing operations of processing units to return the processing units to respective home positions, a processing unit for which a non-home-position state is detected to perform the homing operation, excluding a processing unit for which a home position state is detected; and detecting an abnormal state of each of the processing units, wherein upon detecting an abnormality of any one of the processing units, storing information on the abnormality in an abnormality-information storing unit, and when performing the homing operations of the processing units, determining whether to perform the homing operation of a processing unit from which the abnormality is detected, based on the information stored in the abnormality-information storing unit.

2. A sheet processing device, comprising:

a plurality of processing units provided for performing different functions, the processing units include a moving member;

a home-position detecting unit that detects a home position of the moving member by detecting a part of the moving member using a detecting unit, wherein the home-position detecting unit sets in advance a detection range within which the home position can be recognized, and when the detecting unit detects a part to detect the home position of the moving member in a state in which the moving member is stopped, sets a detection position as the home position by assuming that the detection position is in the detection range without operating the moving member once to move the moving unit out of a detection range of the detecting unit, and the home position is performed immediately after stopping or before starting a sheet feeding or a sheet processing;

a control unit that, when performing homing operations of the processing units for returning the processing units to respective home positions, causes a processing unit for which a non-home-position state is detected to perform the homing operation, excluding a processing unit for which a home position state is detected; and an abnormality detecting unit that detects an abnormal state of each of the processing units, wherein upon detecting an abnormality of any one of the processing units, the abnormality detecting unit stores information on the abnormality in an abnormality-information storing unit, and when performing the homing operations of the processing units, the control unit determines whether to perform the homing operation of a processing unit from which the abnormality is detected, based on the information stored in the abnormality-information storing unit.

3. The sheet processing device according to claim 2, wherein the information includes at least one of an abnormality detection position, an abnormality detection time, and a relationship between a sensor and a motor at a time of detecting the abnormality.

4. The sheet processing device according to claim 2, wherein the abnormality detected by the abnormality detecting unit is an abnormality occurred during the homing operation.

5. The sheet processing device according to claim 2, wherein the abnormality-information storing unit is provided on a sheet-carrying upstream device side, and the sheet processing device further comprises a communication unit that communicates with the storage unit, and the sheet processing device receives the information on the abnormality from the sheet-carrying upstream device via the communication unit.

6. The sheet processing device according to claim 5, wherein the control unit selects a processing unit that performs the homing operation based on an operation mode immediately after stopping or before starting the sheet feeding or the sheet processing.

7. The sheet processing device according to claim 2, wherein the control unit selects a processing unit that performs the homing operation based on an operation mode immediately after stopping or before starting the sheet feeding or the sheet processing.

8. The sheet processing device according to claim 2, further comprising an abnormality detecting unit that detects an abnormality of various mechanisms during the homing operation, wherein when the abnormality detecting unit detects an abnormality, the sheet processing device conveys the sheet to a different path different from a sheet feed path of an operation mode that is in operation.

9. The sheet processing device according to claim 8, wherein the different path is a path for discharging the sheet to a proof tray without performing any processing on the sheet.

10. The sheet processing device according to claim 2, wherein the different functions of the processing units include at least one of punching, aligning, stapling, folding, and cutting.

11. An image forming apparatus, comprising:

a sheet processing device including:

a plurality of processing units provided for performing different functions, the processing units include a moving member;

a home-position detecting unit that detects a home position of the moving member by detecting a part of the moving member using a detecting unit, wherein the home-position detecting unit sets in advance a detection range within which the home position can be recognized, and when the detecting unit detects a part to detect the home position of the moving member in a state in which the moving member is stopped, sets a detection position as the home position by assuming that the detection position is in the detection range without operating the moving member once to move the moving unit out of a detection range of the detecting unit, the home position is performed immediately after stopping or before starting a sheet feeding or a sheet processing a control unit that, when performing homing operations of the processing units for returning the processing units to respective home positions, causes a processing unit for which a non-home-position state is detected to perform the homing operation, excluding a processing unit for which a home position state is detected; and an abnormality detecting unit that detects an abnormal state of each of the processing units, wherein upon detecting an abnormality of any one of the processing units, the abnormality detecting unit stores information on the abnormality in an abnormality-information storing unit, and when performing the homing operations of the processing units, the control unit determines whether to perform the homing operation of a processing unit from which the abnormality is detected, based on the information stored in the abnormality-information storing unit.

* * * * *